US007163743B2

(12) United States Patent
Atwood et al.

(10) Patent No.: US 7,163,743 B2
(45) Date of Patent: Jan. 16, 2007

(54) POLYESTER MONOFILAMENTS

(75) Inventors: Kenneth B. Atwood, Goodlettsville, TN (US); Anne-Marie Coffin, Monroe, NJ (US); John D. Feathers, Vienna, WV (US); Richard Allen Hayes, Brentwood, TN (US); Charles F. Nelson, Parkersburg, WV (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 306 days.

(21) Appl. No.: 10/407,574

(22) Filed: Apr. 4, 2003

(65) Prior Publication Data

US 2004/0197556 A1 Oct. 7, 2004

(51) Int. Cl.
*D01F 6/00* (2006.01)

(52) U.S. Cl. ..... 428/375; 428/395; 428/370; 428/373

(58) Field of Classification Search ..... 428/375, 428/395, 370, 373; 526/343
See application file for complete search history.

(56) References Cited

U.S. PATENT DOCUMENTS

| | | | | |
|---|---|---|---|---|
| 2,627,088 | A | 2/1953 | Alles et al. | |
| 2,698,235 | A | 12/1954 | Swindells | |
| 2,698,240 | A | 12/1954 | Alles et al. | |
| 2,779,684 | A | 1/1957 | Alles | |
| 3,443,950 | A | 5/1969 | Rawlins, Jr. | |
| 3,460,944 | A | 8/1969 | Cohen | |
| 4,683,165 | A * | 7/1987 | Lindemann et al. | 442/173 |
| 4,731,281 | A | 3/1988 | Fleischer et al. | |
| 6,139,955 | A * | 10/2000 | Girgis | 428/375 |
| 6,482,511 | B1 * | 11/2002 | Martinez Antonio | 428/364 |
| 6,635,041 | B1 * | 10/2003 | Popp et al. | 604/385.25 |

* cited by examiner

*Primary Examiner*—N. Edwards
(74) *Attorney, Agent, or Firm*—Gail A. Dalickas

(57) ABSTRACT

The present invention provides monofilaments coated with certain adhesive layers and methods to produce the coated filaments. Also provided are fabrics formed from the monofilaments. The coated monofilaments and fabrics provide improved adhesion with additional coating top layers.

15 Claims, No Drawings

POLYESTER MONOFILAMENTS

BACKGROUND OF THE INVENTION

Polymeric monofilaments are used as reinforcements for rubbers, in fishing lines, in toothbrush bristles, in paintbrush bristles and the like. In addition, woven fabrics produced from monofilaments are used, for example, in industrial belts and paper machine clothing.

Polyester monofilaments offer high strength and good dimensional stability. For example, U.S. Pat. No. 3,051,212 and U.S. Pat. No. 3,869,427 disclose the use of polyester monofilaments as reinforcements for rubber articles. The use of polyester monofilaments to make fabric for processing and drying wet pulp to make paper is described in U.S. Pat. No. 3,858,623, U.S. Pat. No. 4,071,050, U.S. Pat. No. 4,374,960, U.S. Pat. No. 5,169,499, U.S. Pat. No. 5,169,711, U.S. Pat. No. 5,283,110, U.S. Pat. No. 5,297,590, U.S. Pat. No. 5,635,298, U.S. Pat. No. 5,692,938, U.S. Pat. No. 5,885,709, and Kirk-Othmer Encyclopedia of Chemical Technology (2nd Ed.) (Interscience) 1967, Vol. 14, pp. 503–508 and the references cited therein. For example, linear poly(ethylene terephthalate)s having inherent viscosities between 0.60 and 1.0 dL/g are known for use in the production of monofilaments. Generally, it has been disclosed that the inherent viscosity is greater than 0.70 dL/g. U.S. Pat. No. 3,051,212, U.S. Pat. No. 3,627,867, U.S. Pat. No. 3,657,191, U.S. Pat. No. 3,869,427, U.S. Pat. No. 3,959,215, U.S. Pat. No. 3,959,228, U.S. Pat. No. 3,975,329, U.S. Pat. No. 4,016,142, U.S. Pat. No. 4,017,463, U.S. Pat. No. 4,139,521, U.S. Pat. No. 4,374,960, U.S. Pat. No. 5,472,780, U.S. Pat. No. 5,635,298, U.S. Pat. No. 5,763,538, and U.S. Pat. No. 5,885,709 disclose the use of high molecular weight, linear polyesters for use in the manufacture of monofilaments. The inherent viscosity of a polymer is an indicator of its molecular weight.

For many end uses, hydrolysis resistance is desired. Enhancement of hydrolysis resistance by reducing the content of carboxyl end groups is disclosed, for example, in U.S. Pat. No. 3,051,212, U.S. Pat. No. 3,657,191, U.S. Pat. No. 4,139,521, U.S. Pat. No. 4,374,961, U.S. Pat. No. 5,246,992, U.S. Pat. No. 5,378,537 and references cited therein. Hydrolysis stabilization additives have also been disclosed. Generally, the hydrolysis stabilization additives have been disclosed to function by reacting with free polymeric carboxyl end groups. U.S. Pat. No. 3,051,212 and U.S. Pat. No. 4,374,960 disclose the use of diazomethane to "cap" the polyester carboxyl end groups to enhance the hydrolysis resistance. Carbodiimides are disclosed as polyester hydrolysis stabilization additives in U.S. Pat. No. 3,193,522, U.S. Pat. No. 3,193,523, U.S. Pat. No. 3,975,329, U.S. Pat. No. 5,169,499, U.S. Pat. No. 5,169,711, U.S. Pat. No. 5,246,992, U.S. Pat. No. 5,378,537, U.S. Pat. No. 5,464,890, U.S. Pat. No. 5,686,552, U.S. Pat. No. 5,763,538, U.S. Pat. No. 5,885,709 and U.S. Pat. No. 5,886,088. Epoxides are disclosed as polyester hydrolysis stabilization additives in U.S. Pat. No. 3,627,867, U.S. Pat. No. 3,657,191, U.S. Pat. No. 3,869,427, U.S. Pat. No. 4,016,142, U.S. Pat. No. 4,071,504, U.S. Pat. No. 4,139,521, U.S. Pat. No. 4,144,285, U.S. Pat. No. 4,374,960, U.S. Pat. No. 4,520,174, U.S. Pat. No. 4,520,175, and U.S. Pat. No. 5,763,538. Cyclic carbonates, such as ethylene carbonate, are disclosed as hydrolysis stabilization additives in U.S. Pat. No. 3,657,191, U.S. Pat. No. 4,374,960, and U.S. Pat. No. 4,374,961. U.S. Pat. No. 3,959,215 discloses the use of phenylene bisoxazolines for the stabilization of polyesters. Aziridine compounds have been disclosed in the production of low carboxyl polyesters in U.S. Pat. No. 3,959,228 and U.S. Pat. No. 5,763,538. U.S. Pat. No. 5,763,538 discloses the use of keteneimines and isocyanates as polyester monofilament hydrolysis stabilization additives.

Monofilaments having desired surface characteristics can be prepared, for example, by the application of a coating to preformed monofilaments or by the melt spinning of sheath-core bicomponent monofilaments. Monofilaments can also be treated after having been woven into fabrics, as, for example, disclosed by Beaumont, et al., in U.S. Pat. No. 3,032,441. Fleischer, et al., in U.S. Pat. No. 4,731,281, discloses the coating of monofilaments with polymeric solutions or dispersions. Cordova, et al., in U.S. Pat. No. 4,767,646, discloses aqueous based overfinish compositions for monofilaments, which include an oxidized polyethylene emulsified with a non-nitrogen, nonionic emulsifier and neutralized with an alkali hydroxide and a compound selected from the group consisting of a siloxane of the comonomers dimethyl and 3-[(2-aminoethyl)aminopropyl], and an amide melamine wax. Leydon, et al., in U.S. Pat. No. 5,580,609, discloses a method to produce a monofilament coated with an amide melamine wax.

Polyester monofilaments having coatings with improved adhesion to the monofilaments are desired. The processes and monofilaments disclosed herein utilize certain copolymers as adhesives or tie layers that provide enhanced adhesion between the coating materials and the monofilament.

BRIEF SUMMARY OF THE INVENTION

One aspect of the present invention is a monofilament composition comprising a polyester core coated with one or more vinylidene chloride copolymers.

Another aspect of the present invention is a textile fabric produced from a monofilament composition comprising a polyester core coated with one or more vinylidene chloride copolymers.

A further aspect of the present invention is a process for producing a polyester monofilament coated with one or more vinylidene chloride copolymers. The process includes providing a polyester filament and depositing onto the polyester filament a vinylidene chloride copolymer to form a coating.

Another aspect of the present invention is a process for producing a textile fabric comprising a polyester monofilament coated with one or more vinylidene chloride copolymers. The process includes providing a polyester monofilament textile fabric and depositing onto the polyester monofilament textile fabric a vinylidene chloride copolymer to form a coating.

A further aspect of the present invention is a process for improving the adhesion between polyester monofilaments and coatings by depositing onto the polyester monofilaments a vinylidene chloride copolymer tie layer and then applying one or more coatings.

A further aspect of the present invention is a monofilament composition, or textile fabric produced there from, which includes a polyester core, one or more coatings and one or more vinylidene chloride copolymer tie layers.

A further aspect of the present invention is a process for producing a polyester monofilament having a polyester core, one or more coatings and one or more vinylidene chloride copolymer tie layers. The process includes providing a polyester filament, depositing onto the polyester filament a vinylidene copolymer to form a first coating, and depositing onto the first coating a second coating.

Another aspect of the present invention is a process for producing a textile fabric comprising a polyester monofilament having a polyester core, one or more coatings and one or more vinylidene chloride copolymer tie layers. In some embodiments, the process includes providing a polyester monofilament textile fabric and depositing onto the polyester monofilament textile fabric a vinylidene chloride copolymer, and depositing onto said tie layer one or more coatings. In other embodiments, the process includes providing a polyester filament, depositing onto the polyester filament a vinylidene copolymer to form a first coating, depositing onto said first coating a second coating to form a coated polyester monofilament, and forming a textile fabric from the monofilament.

These and other aspects of the invention will be apparent to those skilled in the art in view of the following disclosure and the appended claims.

DETAILED DESCRIPTION OF THE INVENTION

The present invention provides monofilaments comprising a polyester core coated with certain vinylidene chloride copolymers, textile fabrics produced from monofilaments coated with vinylidene chloride copolymers, and processes for producing the monofilaments and textile fabrics. The polyester monofilaments contain 100 to 99 mole percent of a dicarboxylic acid component; 100 to 99 mole percent of a diol; and 0 to 1 mole percent of a polyfunctional branching agent. The dicarboxylic acid component can be selected from dicarboxylic acids and lower esters of dicarboxylic acids.

The dicarboxylic acid component is selected from unsubstituted and substituted aromatic, aliphatic, unsaturated, and alicyclic dicarboxylic acids and the lower alkyl esters of dicarboxylic acids preferably having from 2 carbons to 36 carbons. Specific examples of suitable dicarboxylic acid components include terephthalic acid, dimethyl terephthalate, isophthalic acid, dimethyl isophthalate, 2,6-napthalene dicarboxylic acid, dimethyl-2,6-naphthalate, 2,7-naphthalenedicarboxylic acid, dimethyl-2,7-naphthalate, 3,4'-diphenyl ether dicarboxylic acid, dimethyl-3,4'diphenyl ether dicarboxylate, 4,4'-diphenyl ether dicarboxylic acid, dimethyl-4,4'-diphenyl ether dicarboxylate, 3,4'-diphenyl sulfide dicarboxylic acid, dimethyl-3,4'-diphenyl sulfide dicarboxylate, 4,4'-diphenyl sulfide dicarboxylic acid, dimethyl-4,4'-diphenyl sulfide dicarboxylate, 3,4'-diphenyl sulfone dicarboxylic acid, dimethyl-3,4'-diphenyl sulfone dicarboxylate, 4,4'-diphenyl sulfone dicarboxylic acid, dimethyl-4,4'-diphenyl sulfone dicarboxylate, 3,4'-benzophenonedicarboxylic acid, dimethyl-3,4'-benzophenonedicarboxylate, 4,4'-benzophenonedicarboxylic acid, dimethyl-4,4'-benzophenonedicarboxylate, 1,4-naphthalene dicarboxylic acid, dimethyl-1,4-naphthalate, 4,4'-methylene bis(benzoic acid), dimethyl-4,4'-methylenebis(benzoate), oxalic acid, dimethyl oxalate, malonic acid, dimethyl malonate, succinic acid, dimethyl succinate, methylsuccinc acid, glutaric acid, dimethyl glutarate, 2-methylglutaric acid, 3-methylglutaric acid, adipic acid, dimethyl adipate, 3-methyladipic acid, 2,2,5,5-tetramethylhexanedioic acid, pimelic acid, suberic acid, azelaic acid, dimethyl azelate, sebacic acid, 1,11-undecanedicarboxylic acid, 1,10-decanedicarboxylic acid, undecanedioic acid, 1,12-dodecanedicarboxylic acid, hexadecanedioic acid, docosanedioic acid, tetracosanedioic acid, dimer acid, 1,4-cyclohexanedicarboxylic acid, dimethyl-1,4-cyclohexanedicarboxylate, 1,3-cyclohexanedicarboxylic acid, dimethyl-1,3-cyclohexanedicarboxylate, 1,1-cyclohexanediacetic acid, metal salts of 5-sulfo-dimethylisophalate, fumaric acid, maleic anhydride, maleic acid, hexahydrophthalic acid phthalic acid and the like and mixtures derived there from. Other dicarboxylic acids suitable for use in forming the monofilaments will be apparent to those skilled in the art. Preferred dicarboxylic acids include terephthalic acid, dimethyl terephthalate, isophthalic acid, and dimethyl isophthalate.

The diol component is selected from unsubstituted, substituted, straight chain, branched, cyclic aliphatic, aliphatic-aromatic or aromatic diols having from 2 carbon atoms to 36 carbon atoms and poly(alkylene ether) glycols with molecular weights between about 250 to 4,000. Specific examples of the desirable diol component include ethylene glycol, 1,3-propanediol, 1,4-butanediol, 1,6-hexanediol, 1,8-octanediol, 1,10-decanediol, 1,12-dodecanediol, 1,14-tetradecanediol, 1,16-hexadecanediol, dimer diol, 4,8-bis(hydroxymethyl)-tricyclo[5.2.1.0/2.6]decane, 1,4-cyclohexanedimethanol, di(ethylene glycol), tri(ethylene glycol), poly(ethylene ether) glycols with molecular weights between 250 and 4000, poly(1,2-propylene ether) glycols with molecular weights between 250 and 4000, block poly (ethylene-co-propylene-co-ethylene ether) glycols with molecular weights between 250 and 4000, poly(1,3-propylene ether) glycols with molecular weights between 250 and 4000, poly(butylene ether) glycols with molecular weights between 250 and 4000 and the like and mixtures derived there from. Other diols suitable for use in forming the monofilaments will be apparent to those skilled in the art.

The polyfunctional branching agent can be any material with three or more carboxylic acid functional groups, hydroxy functional groups or a mixture thereof. The term "carboxylic acid functional groups" is meant to include carboxylic acids, lower alkyl esters of carboxylic acids, glycolate esters of carboxylic acids, and the like and mixtures thereof. Specific examples of desirable polyfunctional branching agent components include 1,2,4-benzenetricarboxylic acid, (trimellitic acid), trimethyl-1,2,4-benzenetricarboxylate, tris(2-hyroxyethyl)-1,2,4-benzenetricarboxylate, trimethyl-1,2,4-benzenetricarboxylate, 1,2,4-benzenetricarboxylic anhydride, (trimellitic anhydride), 1,3,5-benzenetricarboxylic acid, 1,2,4,5-benzenetetracarboxylic acid, (pyromellitic acid), 1,2,4,5-benzenetetracarboxylic dianhydride, (pyromellitic anhydride), 3,3',4,4'-benzophenonetetracarboxylic dianhydride, 1,4,5,8-naphthalenetetracarboxylic dianhydride, citric acid, tetrahydrofuran-2,3,4,5-tetracarboxylic acid, 1,3,5-cyclohexanetricarboxylic acid, pentaerythritol, 2-(hydroxymethyl)-1,3-propanediol, 2,2-bis (hydroxymethyl)propionic acid, trimer acid, and the like and mixtures there from. Essentially any polyfunctional material that includes three or more carboxylic acid or hydroxyl functions can be used, and such materials will be apparent to those skilled in the art.

The polyesters preferably have an inherent viscosity (IV) in the range of about 0.50 to 1.5 dL/g. More desirably, the inherent viscosity of the polyesters is in the range of about 0.60 to 1.3 dL/g, as measured on a 0.5 percent (weight/volume) solution of the polyester in a 50:50 (weight) solution of trifluoroacetic acid:dichloromethane solvent system at room temperature. The polymerization conditions can be adjusted by one skilled in the art to obtain the desired inherent viscosities.

The polyesters can be prepared by conventional polycondensation techniques. The product compositions can vary somewhat based on the method of preparation used, particularly with respect to the amount of diol that is present within the polymer. Although not preferred, the polyesters can be prepared using techniques that utilize acid chlorides. Such procedures are disclosed, for example, in R. Storbeck, et al., *J. Appl. Polymer Science*, Vol. 59, pp. 1199–1202 (1996), the disclosure of which is hereby incorporated herein by reference.

Preferably, the polyesters are produced by melt polymerization. In melt polymerization, the dicarboxylic acid component, (as acids, esters, or mixtures thereof, the diol component and the polyfunctional branching agent are combined in the presence of a catalyst to a high enough temperature that the monomers combine to form esters and diesters, then oligomers, and finally polymers. The polymeric product at the end of the polymerization process is a molten product. Generally, the diol component is volatile and distills from the reactor as the polymerization proceeds. Such procedures are disclosed, for example, in U.S. Pat. No. 3,563,942, U.S. Pat. No. 3,948,859, U.S. Pat. No. 4,094,721, U.S. Pat. No. 4,104,262, U.S. Pat. No. 4,166,895, U.S. Pat. No. 4,252,940, U.S. Pat. No. 4,390,687, U.S. Pat. No. 4,419,507, U.S. Pat. No. 4,585,687, U.S. Pat. No. 5,053,482, U.S. Pat. No. 5,292,783, U.S. Pat. No. 5,446,079, U.S. Pat. No. 5,480,962, and U.S. Pat. No. 6,063,464 and references cited therein.

The melt process conditions, particularly the amounts of monomers used, depend on the polymer composition desired. The amount of the diol component, dicarboxylic acid component, and branching agent are desirably chosen so that the final polymeric product contains the desired amounts of the various monomer units, desirably with equimolar amounts of monomer units derived from the respective diol and diacid components. Because of the volatility of some of the monomers, especially some of the diol components, and depending on such variables as whether the reactor is sealed, (i.e., is under pressure), the polymerization temperature ramp rate, and the efficiency of the distillation columns used in synthesizing the polymer, some of the monomers can be used in excess at the beginning of the polymerization reaction and removed by distillation as the reaction proceeds. This is particularly true of the diol component.

The exact amount of monomers to be charged to a particular reactor can be determined by a skilled practitioner, but often will be in the ranges below. Excesses of the diacid and diol are often desirably charged, and the excess diacid and diol is desirably removed by distillation or other means of evaporation as the polymerization reaction proceeds. The diol component is desirably charged at a level 0 to 100 percent greater than the desired incorporation level in the final product. For example, for diol components that are volatile under the polymerization conditions, such as ethylene glycol, 1,3-propanediol, or 1,4-butanediol, 30 to 100 percent excesses are desirably charged. For less volatile diol components, such as the poly(alkylene ether) glycols or dimer diol, excesses may not be required.

The amounts of monomers used can vary widely, because of the wide variation in the monomer loss during polymerization, depending on the efficiency of distillation columns and other kinds of recovery and recycle systems and the like, and are only an approximation. Exact amounts of monomers that are charged to a specific reactor to achieve a specific composition can be determined by a skilled practitioner.

In the melt polymerization process, the monomers are combined, and are heated gradually with mixing with a catalyst or catalyst mixture to a temperature in the range of 220° C. to about 300° C., desirably 240° C. to 295° C. The exact conditions and the catalysts depend on whether the diacids are polymerized as true acids or as dimethyl esters. The catalyst can be included initially with the reactants, and/or can be added one or more times to the mixture as it is heated. The catalyst used can be modified as the reaction proceeds. The heating and stirring are continued for a sufficient time and to a sufficient temperature, generally with removal by distillation of excess reactants, to yield a molten polymer having a high enough molecular weight to be suitable for the intended application.

Catalysts that can be used include salts of Li, Ca, Mg, Mn, Zn, Pb, Sb, Sn, Ge, and Ti, such as acetate salts and oxides, including glycol adducts, and Ti alkoxides. Suitable catalysts are generally known, and the specific catalyst or combination or sequence of catalysts used can be selected by a skilled practitioner. The preferred catalyst and preferred conditions differ depending on, for example, whether the diacid monomer is polymerized as the free diacid or as a dimethyl ester, and the exact chemical identity of the diol component.

Polymers having adequate inherent viscosity for many applications can be made by the melt condensation process above. Solid-state polymerization can be used to achieve even higher inherent viscosities (molecular weights).

Polymers made by melt polymerization, after extruding, cooling and pelletizing, can be essentially noncrystalline. Noncrystalline material can be made semicrystalline by heating it to a temperature above the glass transition temperature for an extended period of time. This induces crystallization so that the product can then be heated to a higher temperature to raise the molecular weight. Semicrystallinity in the polymer may be preferred for some end uses.

Crystallinity can be induced prior to solid-state polymerization by treatment with a relatively poor solvent for polyesters that induces crystallization. Such solvents reduce the glass transition temperature (Tg) allowing for crystallization. Solvent induced crystallization is known for polyesters and is described in U.S. Pat. No. 5,164,478 and U.S. Pat. No. 3,684,766.

The semicrystalline polymer is subjected to solid-state polymerization by placing the pelletized or pulverized polymer into a stream of an inert gas, usually nitrogen, or under a vacuum of 1 Torr, at an elevated temperature, but below the melting temperature of the polymer for an extended period of time.

The polyesters can contain additives, fillers, and/or other materials. Useful additives include thermal stabilizers, antioxidants, UV absorbers, UV stabilizers, processing aids, waxes, lubricants, color stabilizers, and the like. Fillers include calcium carbonate, glass, kaolin, talc, clay, carbon black, and the like. Other materials that can be incorporated include nucleants, pigments, dyes, delusterants such as titanium dioxide and zinc sulfide, antiblocks such as silica, antistats, flame retardants, brighteners, silicon nitride, metal ion sequestrants, anti-staining agents, silicone oil, surfactants, soil repellants, modifiers, viscosity modifiers, zirconium acid, reinforcing fibers, and the like. The additives, fillers, and other materials can be incorporated within the polyesters by a separate melt compounding process utilizing any known intensive mixing process, such as extrusion; by intimate mixing with solid granular polymer, such as pellet blending, or by cofeeding within the monofilament process.

The polyesters can be blended with other polymers. Such other polymers include polyolefins, such as polyethylene, polypropylene, polybutene, poly-4-methyl pentene, polystyrene, and the like; cyclic olefin polymers, modified polyolefins, such as copolymers of various alpha-olefins, glycidyl esters of unsaturated acids, ionomers, ethylene/vinyl copolymers such as ethylene/vinyl chloride copolymers, ethylene/vinyl acetate copolymers, ethylene/acrylic acid copolymers, ethylene/methacrylic acid copolymers and the like, thermoplastic polyurethanes, polyvinyl chloride, polyvinlidene chloride copolymers, liquid crystalline polymers, fluorinated polymers such as polytetrafluoroethylene, ethylene tetrafluoroethylene copolymers, tetrafluoroethylene hexafluoropropylene copolymers, polyfluoroalkoxy copolymers, polyvinylidene fluoride, polyvinylidene copolymers, ethylene chlorotrifluoroethylene copolymers, and the like, polyamides, such as Nylon-6, Nylon-66, Nylon 69, Nylon 610, Nylon 611, Nylon 612, Nylon 11, Nylon 12, and copolymers and the like, polyimides, polyphenylene sulfide, polyphenylene oxide, polysulfones, polyethersulfones, rubbers, polycarbonate, polyacrylates, terpene resins, polyacetal, styrene/acrylonitrile copolymers, styrene/maleic anhydride copolymers, styrene/maleimide copolymers, coumarone/indene copolymers, and the like and combinations thereof. Polyester monofilaments that incorporate thermoplastic polyurethanes are disclosed in U.S. Pat. No. 5,169,711 and U.S. Pat. No. 5,652,057. Polyester monofilaments that incorporate polyphenylene sulfide are disclosed in U.S. Pat. No. 5,218,043, U.S. Pat. No. 5,424,125, and U.S. Pat. No. 5,456,973. Polyester monofilaments that incorporate fluoropolymers are disclosed in U.S. Pat. No. 5,283,110, U.S. Pat. No. 5,297,590, U.S. Pat. No. 5,378,537, U.S. Pat. No. 5,407,736, U.S. Pat. No. 5,460,869, U.S. Pat. No. 5,472,780, U.S. Pat. No. 5,489,467, and U.S. Pat. No. 5,514,472. Polyester monofilaments that incorporate nonfluorine-containing polymers are disclosed in U.S. Pat. No. 5,686,552. Polyester monofilaments that incorporate liquid crystalline polymers are disclosed in U.S. Pat. No. 5,692,938.

The other polymers can be incorporated within the polyesters by a separate melt compounding process utilizing any known intensive mixing process, such as extrusion through a single or twin screw extruder, through intimate mixing with the solid granular material, such as mixing, stirring or pellet blending operations, or through cofeeding within the monofilament process.

The polyesters can be stabilized with an effective amount of any hydrolysis stabilization additive. The hydrolysis stabilization additive can be any known material that enhances the stability of the polyester monofilament to hydrolytic degradation. Examples of the hydrolysis stabilization additive can include: diazomethane, carbodiimides, epoxides, cyclic carbonates, oxazolines, aziridines, keteneimines, isocyanates, alkoxy end-capped polyalkylene glycols, and the like. Any material that increases the hydrolytic stability of the monofilaments formed from the polyesters is suitable.

Preferred hydrolysis stabilization additives are carbodiimides. Specific examples of carbodiimides include N,N'-di-o-tolylcarbodiimide, N,N'-diphenylcarbodiimide, N,N'dioctyldecylcarbodiimide, N,N'-di-2,6-dimethylphenylcarbodiimide, N-tolyl-N'cyclohexylcarbodiimide, N,N'-di-2,6-diisopropylphenylcarbodiimide, N,N'di-2,6-di-tert.-butylphenylcarbodiimide, N-tolyl-N'-phenylcarbodiimide, N,N'-di-p-nitrophenylcarbodiimide, N,N'di-p-aminophenylcarbodiimide, N,N'-di-p-hydroxyphenylcarbodiimide, N,N'-di-cyclohexylcarbodiimide, N,N'-di-p-tolylcarbodiimide, p-phenylene-bis-di-o-tolylcarbodiimide, p-phenylene-bisdicyclohexylcarbodiimide, hexamethylene-bisdicyclohexylcarbodiimide, ethylene-bisdiphenylcarbodiimide, benzene-2,4-diisocyanato-1,3,5-tris(1-methylethyl) homopolymer, a copolymer of 2,4-diisocyanato-1,3,5-tris(10methylethyl) with 2,6-diisoproyl diisocyanate, and the like. Such materials are commercially sold under the tradenames: STABAXOL 1, STABAXOL P, STABAXOL P-100, STABAXOL KE7646, (Rhein-Chemie, of Rheinau GmbH, Germany and Bayer). The use of carbodiimides as polyester hydrolysis stabilization additives is disclosed in U.S. Pat. No. 3,193,522, U.S. Pat. No. 3,193,523, U.S. Pat. No. 3,975,329, U.S. Pat. No. 5,169,499, U.S. Pat. No. 5,169,711, U.S. Pat. No. 5,246,992, U.S. Pat. No. 5,378,537, U.S. Pat. No. 5,464,890, U.S. Pat. No. 5,686,552, U.S. Pat. No. 5,763,538, U.S. Pat. No. 5,885,709 and U.S. Pat. No. 5,886,088.

Specific examples of epoxides suitable as hydrolysis stabilization additives include iso-nonyl-glycidyl ether, stearyl glycidyl ether, tricyclo-decylmethylene glycidyl ether, phenyl glycidyl ether, p-tert.-butylphenyl glycidyl ether, o-decylphenyl glycidyl ether, allyl glycidyl ether, butyl glycidyl ether, lauryl glycidyl ether, benzyl glycidyl ether, cyclohexyl glycidyl ether, alpha-cresyl glycidyl ether, decyl glycidyl ether, dodecyl glycidyl ether, N-(epoxyethyl) succinimide, N-(2,3-epoxypropyl)phthalimide, and the like. Catalysts can be included to increase the rate of reaction, for example; alkali metal salts. Epoxides are disclosed as polyester hydrolysis stabilization additives in U.S. Pat. No. 3,627,867, U.S. Pat. No. 3,657,191, U.S. Pat. No. 3,869,427, U.S. Pat. No. 4,016,142, U.S. Pat. No. 4,071,504, U.S. Pat. No. 4,139,521, U.S. Pat. No. 4,144,285, U.S. Pat. No. 4,374,960, U.S. Pat. No. 4,520,174, U.S. Pat. No. 4,520,175, U.S. Pat. No. 5,763,538, and U.S. Pat. No. 5,886,088.

Specific examples of cyclic carbonates suitable as hydrolysis stabilization additives include ethylene carbonate, methyl ethylene carbonate, 1,1,2,2-tetramethyl ethylene carbonate, 1,2-diphenyl ethylene carbonate, and the like. Cyclic carbonates, such as ethylene carbonate, are disclosed as hydrolysis stabilization additives in U.S. Pat. No. 3,657,191, U.S. Pat. No. 4,374,960, and U.S. Pat. No. 4,374,961.

The amount of hydrolysis stabilization additive required to lower the carboxyl concentration of the polyester during its conversion to monofilaments is dependent on the carboxyl content of the polyester prior to extrusion into monofilaments. In general, the amount of hydrolysis stabilization additive used is from 0.1 to 10.0 weight percent based on the polyester. Preferably the amount of the hydrolysis stabilization additive used is in the range of 0.2 to 4.0 weight percent.

The hydrolysis stabilization additive can be incorporated within the branched polyesters by a separate melt compounding process as disclosed hereinabove for incorporation of other polymers into the polyesters. However, it is preferred that the hydrolysis additive is incorporated through cofeeding within the monofilament process.

The polyesters can be formed into monofilaments by known methods such as, for example, methods disclosed in U.S. Pat. No. 3,051,212, U.S. Pat. No. 3,999,910, U.S. Pat. No. 4,024,698, U.S. Pat. No. 4,030,651, U.S. Pat. No. 4,072,457, and U.S. Pat. No. 4,072,663. As one skilled in the art will appreciate, the process can be tailored to take into account the exact material to be formed into monofilaments, the physical and chemical properties desired in the monofilament and the like. The exact determination of the spinning parameters for achieving a certain combination of monofilament properties can be routinely carried out by determining the dependence of the contemplated monofilament property on the composition for the polyester and on the spinning parameters.

The polyesters are preferably dried prior to their formation into monofilaments. To form monofilaments, the polyesters are melted at a temperature in the range of about 150° C. to about 300° C. Preferably, the polyesters are melted at a temperature within the range of about 170° C. to about 290° C. The spinning can generally be carried out by use of a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized by the use of the shortest practical length of pipes between the melting of the polyester and the spinneret. The molten polyester can be filtered through, for example, screen filters, to remove any particulate foreign matter. The molten polyester can then be conveyed, optionally through a metering pump, through a die to form a monofilament. After exiting the die, the monofilaments can be quenched in an air or a water bath to form solid monofilaments. The monofilament can optionally be spin finished. The monofilaments can be drawn at elevated temperatures up to 100° C. between a set of draw rolls. If the temperature is too high, sticking may occur and/or control over the drawing of the monofilaments may be lost. The monofilaments are preferably drawn to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. Draw ratio is defined as the ratio of the drawn monofilament length to the undrawn monofilament length. The finished cooled monofilaments can then be wound up onto spools. Any known process for producing monofilaments can be used to form monofilaments from the polyesters.

In order to provide the desired tenacity, the filaments can be drawn to a ratio of at least about 2:1. Preferably the filaments are drawn to a ratio of at least about 4:1. The overall draw ratio can be varied to allow for the production of a range of denier of the monofilaments.

Monofilaments can range in size over a broad range depending on intended use, preferably from a diameter of about 0.05 millimeters (mm) to about 5.0 mm. Typical ranges of sizes of monofilaments used in press fabrics and dryer fabrics are 0.20 mm to 1.27 mm in diameter. Depending upon the cross-sectional shape of the monofilaments, monofilaments having masses within the mass of a typical monofilament having a diameter within the stated range can be produced, and may have diameters outside the above-stated range. For forming fabrics, finer monofilaments are generally used, for example, as small as 0.05 mm to about 0.9 mm in diameter. Most often, the monofilaments used in forming fabrics have a diameter between about 0.12 mm to about 0.4 mm. On the other hand, for special industrial applications, monofilaments of 3.8 mm in diameter or greater can be desired.

The monofilaments can take any cross-sectional shape, for example; as circle, flattened figure, square, triangle, pentagon, polygon, multifoil, dumbbell, cocoon. The term "flattened figure" as used herein refers to an ellipse or a rectangle. The term not only embraces a geometrically defined exact ellipse and rectangle but also shapes similar to an ellipse or a rectangle, e.g., an imperfect ellipse or an irregular polygon, and includes a shape obtained by rounding the four corners of a rectangle. When a monofilament is intended as a warp in a papermaking drier canvas, a monofilament having the cross-sectional shape of a flattened figure is preferably used to improve the resistance against staining and ensure a flatness of the produced drier canvas. The monofilaments can further be woven into textile fabrics, using known processes.

Vinylidene copolymers suitable for use in making the polyester filaments comprise from about 35 to about 96 weight percent vinylidene chloride and from about 65 to about 4 weight percent of at least one other polymerizable olefin monomer.

The vinylidene chloride copolymer can also include one or more copolymerizable olefin monomers selected from the group consisting of vinyl acetate, vinyl propionate, vinyl chloroacetate, vinyl chloride, vinyl bromide, methyl acrylate, ethyl acrylate, propyl acrylate, butyl acrylate, octyl acrylate, n-dodecyl acrylate, n-octadecyl acrylate, methoxyethyl acrylate, chloroethyl acrylate, methyl methacrylate, ethyl methacrylate, propyl methacrylate, butyl methacrylate, octyl methacrylate, n-dodecyl methacrylate, n-octadecyl methacrylate, methoxyethyl methacrylate, chloroethyl methacrylate, 2-nitro-2-methyl-propyl methacrylate, methyl alpha-chloroacrylate, octyl alpha-chloroacrylate, acrylic acid, methacrylic acid, methyl vinyl ketone, methyl isopropenyl ketone, itaconic acid, acrylonitrile, methacrylonitrile, styrene, isobutylene, vinyl naphthalene, ethyl vinyl ether, butyl vinyl ether, N-vinyl phthalimide, N-vinyl succinimide, N-vinyl carbazole, N-vinyl pyrollidone, methylene diethyl malonate, and the like. Any other polymerizable olefin monomer known can be used in making the polyesters.

Suitable vinylidene copolymers can be produced by any known method. Suitable methods are disclosed in U.S. Pat. No. 2,160,903, U.S. Pat. No. 2,160,931, U.S. Pat. No. 2,160,932, U.S. Pat. No. 2,160,933, U.S. Pat. No. 2,160,934, U.S. Pat. No. 2,160,935, U.S. Pat. No. 2,160,936, U.S. Pat. No. 2,160,937, U.S. Pat. No. 2,160,938, U.S. Pat. No. 2,160,939, U.S. Pat. No. 2,160,940, U.S. Pat. No. 2,160,941, U.S. Pat. No. 2,160,942, U.S. Pat. No. 2,160,943, U.S. Pat. No. 2,160,945, U.S. Pat. No. 2,160,946, and U.S. Pat. No. 2,160,947. Preferably, the vinylidene monomers are produced through emulsion polymerization to directly produce dispersions, using known methods. Suitable methods are disclosed in U.S. Pat. No. 2,491,023.

Preferably, the vinylidene copolymers comprise from about 35 to about 96 weight percent vinylidene chloride, 3.5 to 64.5 weight percent of an acrylic ester, and 0.5 to 25 weight percent of itaconic acid. More preferably, the vinylidene copolymers comprise from about 75 to about 95 weight percent vinylidene chloride, 4 to 20 weight percent of an acrylic ester, and 1 to 5 weight percent of itaconic acid. The acrylic ester can be, for example, an alkyl ester of acrylic acid or methacrylic acid with 1 to 18 carbon atoms in the alkyl group, such as methyl acrylate, ethyl acrylate, propyl acrylate, butyl acrylate, octyl acrylate, n-dodecyl acrylate, n-octadecyl acrylate, methyl methacrylate, ethyl methacrylate, propyl methacrylate, butyl methacrylate, octyl methacrylate, n-dodecyl methacrylate, n-octadecyl methacrylate, and the like and mixture thereof.

The vinylidene chloride copolymers can be produced using any known methods. Preferably they are produced through emulsion polymerization to directly produce dispersions according to known methods. Suitable methods are disclosed in U.S. Pat. No. 2,627,088, U.S. Pat. No. 2,698,235, and U.S. Pat. No. 2,698,240. For example, the copolymerization can be conducted in an aqueous emulsion containing a mixture of the monomers, a catalyst, and an activator, e.g., ammonium persulfate and meta sodium bisulfite, and an emulsifying and/or dispersing agent. Alternatively, the vinylidene chloride copolymers can be prepared by polymerization of the monomeric components in bulk without added diluent, or the monomers can be reacted in an appropriate organic solvent reaction media. The total catalyst-activator concentration should be generally kept within a range of about 0.01 to about 2 weight percent based on the total monomer charge. Preferably, the total catalyst-activator concentration should be generally kept within a range of about 0.1 to 1.0 weight percent. Improved solubility and viscosity values for the vinylidene copolymer are obtained by conducting the polymerization in the presence of mercaptans, such as ethyl mercaptan, lauryl mercaptan, tertiary dodecyl mercaptan, and the like. The mercaptans are effective in reducing crosslinking in the vinylidene chloride copolymer. Typically, the mercaptans are used in the concentrations of 0.1 to 5 weight percent based on the total monomer charge.

Preferably, the vinylidene chloride copolymer is blended with an additional polymer selected from polyacrylate esters, such as alkyl acrylate and/or alkyl methacrylate homopolymers or copolymers that incorporate at least 75 weight percent of an alkyl acrylate and/or alkyl methacrylate monomer. The alkyl acrylate and alkyl methacrylate monomers can be chosen from a group of alkyl esters of acrylic acid or methacrylic acid with 1 to 18 carbon atoms in the alkyl group, for example; methyl acrylate, ethyl acrylate, propyl acrylate, butyl acrylate, octyl acrylate, n-dodecyl acrylate, n-octadecyl acrylate, methyl methacrylate, ethyl methacrylate, propyl methacrylate, butyl methacrylate, octyl methacrylate, n-dodecyl methacrylate, n-octadecyl methacrylate, and the like, and mixture thereof. These polymers can be produced through emulsion polymerization, for example, as disclosed in U.S. Pat. No. 3,325,286 and U.S. Pat. No. 3,460,944. These blends can contain from 90 to 60 weight percent of the vinylidene copolymer, based on the total blend weight. Suitable blends are disclosed in U.S. Pat. No. 3,460,944. A convenient method of preparing such blends is to start with two dispersions containing the same percentage of solids and mix these in the desired proportions by volume.

A more convenient, preferred method for preparing the vinylidene chloride copolymer—polyacrylate ester blends is through the sequential emulsion polymerization process disclosed in U.S. Pat. No. 3,443,950. For example, in making the blend compositions, 90 to 60 parts, by weight, of an aqueous dispersion of the vinylidene chloride copolymer is mixed with from 10 to 40 parts, by weight, of a monomer of the alkyl acrylate and/or the alkyl methacrylate, 0.01 20 5.0 percent or more, by weight, of an addition polymerization initiator and, if desired, additional water and a dispersing agent, and then the monomer is polymerized at a temperature from 30° C. to 55° C. for 30 to 120 minutes.

The vinylidene chloride copolymers can be coated onto the polyester monofilament or textile fabrics produced from the polyester monofilament by any known process including, for example, spray down, solution coating, emulsion coating and the like. The coating process can be integrated into the polyester monofilament production process, be performed in line just after the monofilament process, be performed on preformed polyester monofilament as a separate operation, be integrated into the fabric weaving process, be performed in line just after the monofilament weaving process or be performed on preformed textile fabrics woven from polyester monofilaments.

Preferably, the vinylidene chloride-coated polyester monofilaments are drawn at elevated temperatures up to 100° C. between a set of draw rolls to a draw ratio of from 3.0:1 to 4.5:1. The vinylidene chloride-coated polyester monofilaments can optionally be further drawn at a higher temperature of up to 250° C. Preferably, if the coated polyester monofilaments are further drawn, they are drawn to a draw ratio of no more than 6.5:1 and then allowed to relax by up to about 30 percent of their drawn length while heated. Drawing at elevated temperatures provides enhanced adhesion between the polyester filament and the vinylidene chloride coating. Drawing at elevated temperatures can be done on the polyester monofilaments before and/or after the vinylidene chloride is applied to the monofilaments. Moreover, the drawing process can be carried out on the vinylidene chloride-coated polyester monofilaments when the vinylidene chloride coating, also referred to as a first coating, is to function as a tie layer prior to the application of a second coating.

Preferably, the vinylidene chloride-coated polyester monofilaments or vinylidene chloride-coated textile fabrics produced from the polyester monofilaments are heat set at a temperature in the range of 100° C. to 220° C., preferably in the range of 160° C. to 180° C. Heat setting stabilizes the dimensional stability of the vinylidene chloride-coated polyester monofilament or polyester monofilament textile fabric and further provides enhanced adhesion between the polyester monofilament and the vinylidene chloride coating. Heat setting can be carried prior to and/or after the application of the vinylidene chloride coating to the polyester monofilaments, and/or after the application of a second coating. In preferred embodiments, drawing at elevated temperatures and heat setting is carried out after the application of the vinylidene chloride onto the polyester monofilaments.

For example, the dried polyesters are melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a bath containing an aqueous emulsion of the vinylidene chloride copolymer and the coated solid filaments are then conveyed to a dryer whereby the water is removed. These vinylidene chloride copolymer-coated polyester monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage.

As a further example, the dried polyesters are melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and the solid filaments are then conveyed to a second bath containing either a solution or an aqueous emulsion of the vinylidene chloride copolymer and the coated solid filaments are then conveyed to a dryer whereby the solvent and/or water is removed. The vinylidene chloride copolymer-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. Also preferably, the vinylidene chloride-coated polyester monofilaments are preferably heat set at a temperature in the range of 100° C. to 220° C., preferably in the range of 160° C. to 180° C.

As a further example, the dried polyesters are melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and the solid filaments are then conveyed to a dryer whereby the water is removed. The solid filaments are then conveyed to a bath containing either a solution or an aqueous emulsion of the vinylidene chloride copolymer and the coated solid filaments are then conveyed to a dryer whereby the solvent and/or water is removed. The vinylidene chloride copolymer-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C.

As a further example, the dried polyesters are melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and the solid filaments are then conveyed to a dryer whereby the solvent and/or water is removed. The vinylidene chloride copolymer-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C.

As a further example, the dried polyesters are melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and The spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and then conveyed to a dryer whereby the water is removed. A solution or an aqueous emulsion of the vinylidene chloride copolymer is then pumped by a metering pump through nozzles and sprayed onto the polyester filament. The coated solid filaments am then conveyed to a dryer whereby the solvent and/or water is removed. The vinylidene chloride copolymer-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C.

As a further example, the dried polyesters are melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and the solid filaments are then conveyed to a dryer whereby the water is removed. The polyester monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The solid filaments are then conveyed to a bath containing either a solution or an aqueous emulsion of the vinylidene chloride copolymer and the coated solid filaments are then conveyed to a dryer whereby the solvent and/or water is removed. The polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C.

As a further example, the dried polyesters are melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath. The solid filaments are then conveyed to a dryer whereby the water is removed. The polyester monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. A solution or an aqueous emulsion of the vinylidene chloride copolymer is then pumped by a metering pump through nozzles and sprayed onto the polyester filament. The coated solid filaments are then conveyed to a dryer whereby the solvent and/or water is removed. The polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C.

Preformed polyester monofilament can also be coated. For example, preformed polyester filament can be removed from spools and conveyed into a bath containing either a solution or an aqueous emulsion of the vinylidene chloride copolymer. The coated polyester monofilament is then conveyed through a dryer and the solvent and/or water is removed. The polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. Alternatively, preformed polyester filament can be removed from spools and a solution or an aqueous emulsion of the vinylidene chloride copolymer is pumped through nozzles by a metering pump and sprayed onto the polyester monofilament. The coated polyester monofilament is then conveyed through a dryer and the solvent and/or water is removed. The coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. These vinylidene chloride-coated polyester monofilaments are preferably heat set at a temperature in the range of 100° C. to 220° C., preferably in the range of 160° C. to 180° C.

Woven fabrics produced from polyester monofilaments by conventional processes can also be coated. For example, a woven textile fabric is conveyed through a bath containing either a solution or an aqueous emulsion of the vinylidene chloride copolymer. Preferably, the excess solution or emulsion contained within the interstices of the fabric is removed. This can be performed by passing the treated fabric over a vacuum box or by blowing it out with pressurized air or inert gases, such as nitrogen and the like. The coated woven textile fabric is then conveyed through a dryer and any solvent and/or water is removed. As a further example, preformed woven textile fabric is sprayed with a solution or an aqueous emulsion of the vinylidene chloride copolymer, pumped through nozzles by a metering pump. Preferably, the excess solution or emulsion contained within the interstices of the fabric is removed according to methods described hereinabove. The coated woven textile fabric is then conveyed through a dryer and the solvent and/or water is removed.

Preferably, the vinylidene chloride-coated textile fabrics produced from the polyester monofilaments are heat set at a temperature in the range of 100° C. to 220° C., preferably in the range of 160° C. to 180° C. The heat set process stabilizes the dimensional stability of the vinylidene chloride-coated polyester monofilament textile fabric and further provides enhanced adhesion between the polyester monofilament and the vinylidene chloride coating.

The vinylidene chloride copolymer-coated polyester monofilaments or fabrics can include from 0.01 to 50 weight percent of the vinylidene chloride copolymer based on the final weight of the vinylidene chloride copolymer-coated polyester monofilament. Preferably, the vinylidene chloride copolymer-coated polyester monofilaments or fabrics can include from 0.01 to 10 weight percent of the vinylidene chloride copolymer based on the final weight of the vinylidene chloride copolymer-coated polyester monofilament. More preferably, the vinylidene chloride copolymer-coated polyester monofilaments or fabrics can include from 0.1 to 5 weight percent of the vinylidene chloride copolymer based on the final weight of the vinylidene chloride copolymer-coated polyester monofilament.

The monofilaments are useful, for example, as reinforcements for rubbers, fishing lines, toothbrush bristles, paintbrush bristles and the like. When woven into fabrics, the monofilaments can be utilized in making industrial belts and paper machine clothing.

In some embodiments, the present invention provides monofilaments having a polyester core, a vinylidene chloride coating, and one or more additional coatings. In such embodiments, the vinylidene chloride coating functions as a "tie layer", and may be referred to as a tie layer herein.

Materials used to coat the polymers can be monomeric or polymeric. Suitable monomeric coating materials include, for example, fluorinated surfactants. Suitable polymeric coating materials include, for example, polyolefins, such as polyethylene, polypropylene, polybutene, poly-4-methyl pentene, polystyrene, and the like, cyclic olefin polymers, modified polyolefins, such as oxidized polyethylene, polyolefin copolymers, such as copolymers of various alpha-olefins, glycidyl esters of unsaturated acids, ionomers, ethylene/vinyl copolymers such as ethylene/vinyl chloride copolymers, ethylene/vinyl acetate copolymers, ethylene/acrylic acid copolymers, ethylene/methacrylic acid copolymers and the like, ethylene/vinyl alcohol copolymers, poly (vinyl alcohol), poly(vinyl alcohol-cobutyral), polyurethanes, thermoplastic polyurethanes, polyvinyl chloride, polyvinylidene chloride copolymers, liquid crystalline polymers, fluorinated polymers, such as polytetrafluoroethylene, ethylene tetrafluoroethylene copolymers, tetrafluoroethylene hexafluoropropylene copolymers, polyfluoroalkoxy copolymers, polyvinylidene fluoride, polyvinylidene copolymers, ethylene chlorotrifluoroethylene copolymers, and the like, polyamides, such as Nylon-6, Nylon-66, Nylon 69, Nylon 610, Nylon 611, Nylon 612, Nylon 11, Nylon 12, and copolymers and the like, polyimides, polyphenylene sulfide, polyphenylene oxide, polysulfones, polyethersulfones, rubbers, polycarbonate, polyacrylates, terpene resins, polyacetal, styrene/acrylonitrile copolymers, styrene/maleic anhydride copolymers, styrene/maleimide copolymers, coumarone/indene copolymers, and combinations thereof.

The coating materials can contain known additives. Such additives can include thermal stabilizers such as, for example, phenolic antioxidants; secondary thermal stabilizers such as, for example, thioethers and phosphates; UV absorbers such as, for example benzophenone- and benzotriazole-derivatives; UV stabilizers; and hindered amine light stabilizers (HALS). Other suitable additives include plasticizers, processing aids, flow enhancing additives, lubricants, pigments, conductive materials, such as carbon black or metal fibers, flame retardants, impact modifiers, nucleating agents to increase crystallinity, antiblocking agents such as silica, and base buffers, such as sodium acetate, potassium acetate, and tetramethyl ammonium hydroxide. In addition, the polyester compositions can include inorganic, organic and clay fillers, for example, wood flour, gypsum, wollastonite, montmorillonite minerals, chalk, kaolin, clay, silicon oxide, calcium terephthalate, aluminum oxide, titanium oxide, calcium phosphate, lithium fluoride, cellulose, starch, chemically modified starch, thermoplastic starch, calcium carbonate, calcium hydroxide, reinforcing agents, such as glass, and the like. Other suitable additives will be known to those skilled in the art and can be selected depending upon the intended end use of the polyesters.

The coatings can be applied through solution coating processes, emulsion coating processes or melt coating processes. The coating process is typically performed in line with the addition of the vinylidene chloride copolymer to the monofilament or to a woven textile fabric produced from the monofilament. The coating process can be integrated into the polyester monofilament production process, be performed in line just after the monofilament process, be performed on preformed polyester monofilament as a separate operation, integrated as part of the weaving process, be performed in line with the weaving process or be performed on preformed woven textile fabrics as a separate operation. The solution and emulsion coating processes can be performed, for example, through successive baths containing the vinylidene chloride copolymer and the coating material and/or through spray down processes whereby the solutions or emulsions are sprayed onto the fiber or fabric. Suitable solution and emulsion coating processes are disclosed, for example, in U.S. Pat. No. 2,698,235 and U.S. Pat. No. 2,779,684. Melt coating can be carried out using any known melt coating process. Suitable melt coating processes are disclosed in, for example, U.S. Pat. No. 4,297,413, U.S. Pat. No. 4,839,132, U.S. Pat. No. 4,894,195, U.S. Pat. No. 5,573,850, and U.S. Pat. No. 5,601,775 and references cited therein, and in the Handbook of Plastic Materials and Technology, p 1208, John Wiley & Sons, Inc., New York (1990). The melt coating processes can include contacting the vinylidene chloride copolymer coated polyester monofilament with the molten coating material. For example, the vinylidene chloride copolymer coated polyester monofilament can be continuously fed through a melt of the coating material in a crosshead pressure extrusion die where the coating is applied. From the die, the coated polyester monofilament is conveyed through a cooling zone and then taken up on a spool. Such crosshead pressure extrusion dies and processes are well known as wire-coating pressure dies. In such a process, the melt temperature of the coating material can be below, at, or above the melting temperature of the polyester monofilament.

Preferably, the vinylidene chloride-coated polyester monofilaments are drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage before the application of the second coating. The preferable drawing process provides enhanced adhesion between the polyester filament and the vinylidene chloride coating.

Preferably, the vinylidene chloride-coated polyester monofilaments or vinylidene chloride-coated textile fabrics produced from the polyester monofilaments are heat set at a temperature in the range of 100° C. to 220° C., preferably in the range of 160° C. to 180° C. before the application of the second coating. Heat setting stabilizes the dimensional stability of the vinylidene chloride-coated polyester monofilament or polyester monofilament textile fabric and further provides enhanced adhesion between the polyester monofilament and the vinylidene chloride coating.

For example, the dried polyesters can be melted at a temperature in the range of about 150° C. to about 300° C. Preferably, the polyesters are melted at a temperature within the range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade due to time and temperature in the melt. It is preferred that the time that the polyester is in the melt is minimized, which can be accomplished by using the shortest practical length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a bath containing an aqueous emulsion of the vinylidene chloride copolymer, thus coating the monofilaments, and the coated solid filaments are then conveyed to a dryer for removal of water. The vinylidene chloride-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The vinylidene chloride copolymer-coated polyester monofilaments are then conveyed to a second bath containing an aqueous emulsion or a solution of the coating material. The coated monofilaments are then conveyed through a dryer and can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage.

Alternatively, for example, the dried polyesters can be melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and the solid filaments are then conveyed to a second bath containing either a solution or an aqueous emulsion of the vinylidene chloride copolymer and the coated solid filaments are then conveyed to a dryer whereby the solvent and/or water is removed. The vinylidene chloride-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The vinylidene chloride copolymer-coated polyester monofilaments are then conveyed through a third bath containing a solution or an aqueous emulsion of the coating material. The coated monofilaments are then dried and can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage.

As a further example, the dried polyesters can be melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest practical length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and the solid filaments are then conveyed to a second bath containing either a solution or an aqueous emulsion of the vinylidene chloride copolymer. The wet vinylidene chloride copolymer coated polyester monofilaments are then conveyed through a third bath containing a solution or an aqueous emulsion of the coating material. The coated solid filaments are then conveyed to a dryer whereby the solvent and/or water is removed. The coated monofilaments then can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The coated polyester monofilaments are preferably heat set at a temperature in the range of 100° C. to 220° C., more preferably in the range of 160° C. to 180° C.

As a further example, the dried polyesters can be melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and the solid filaments are then conveyed to a dryer whereby the water is removed. The solid filaments are then conveyed to a bath containing either a solution or an aqueous emulsion of the vinylidene chloride copolymer and the coated solid filaments are then conveyed to a dryer whereby the solvent and/or water is removed. The vinylidene chloride copolymer-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The vinylidene chloride copolymer coated polyester monofilaments are then conveyed through a bath containing a solution or an aqueous emulsion of the coating material and then dried to remove solvent and/or water.

As a further example, the dried polyesters can be melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath. A solution or an aqueous emulsion of the vinylidene chloride copolymer is then pumped by a metering pump through nozzles and sprayed onto the polyester filament. A solution or an aqueous emulsion of the coating material is then pumped by a metering pump through nozzles and sprayed onto the vinylidene chloride copolymer coated polyester monofilaments. The solid filaments are then conveyed to a dryer whereby the solvent and/or water is removed. The coated polyester monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The coated polyester monofilaments are preferably heat set at a temperature in the range of 100° C. to 220° C., preferably in the range of 160° C. to 180° C.

As a further example, the dried polyesters can be melted at a temperature in the range of about 150° to about 300° C. Preferably, the polyesters are melted in the temperature range of about 170° to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and then conveyed to a dryer whereby the water is removed. A solution or an aqueous emulsion of the vinylidene chloride copolymer is then pumped by a metering pump through nozzles and sprayed onto the polyester filament. The vinylidene chloride copolymer coated solid filaments are then conveyed to a dryer whereby the solvent and/or water is removed. The vinylidene chloride-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The monofilaments are then conveyed into a bath containing a solution or an aqueous emulsion of the coating material. These coated polyester monofilaments are then conveyed through a dryer and the water and/or solvent is removed and then they can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage.

As a further example, the dried polyesters can be melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and the solid filaments are then conveyed to a dryer whereby the water is removed. The polyester monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The solid filaments are then conveyed to a bath containing either a solution or an aqueous emulsion of the vinylidene chloride copolymer and the coated solid filaments are then conveyed to a dryer whereby the solvent and/or water is removed. The vinylidene chloride-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The vinylidene chloride copolymer coated polyester monofilaments are then conveyed to a bath containing a solution or an aqueous emulsion of the coating material and the coated solid filaments are then conveyed to a dryer whereby the solvent and/or water is removed.

As a further example, the dried polyesters can be melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath. The solid filaments are then conveyed to a dryer whereby the water is removed. The polyester monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage.

A solution or an aqueous emulsion of the vinylidene chloride copolymer is then pumped by a metering pump through nozzles and sprayed onto the polyester filament. A solution or an aqueous emulsion of the coating material is then pumped by a metering pump through nozzles and sprayed onto the polyester monofilament. The coated solid filaments are then conveyed to a dryer whereby the solvent and/or water is removed. The coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The coated polyester monofilaments are preferably heat set at a temperature in the range of 100° C. to 220° C., preferably in the range of 160° C. to 180° C.

For example, the dried polyesters can be melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a bath containing an aqueous emulsion of the vinylidene chloride copolymer and the coated solid filaments are then conveyed to a dryer whereby the water is removed. The vinylidene chloride copolymer coated monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The coated polyester monofilaments are preferably heat set at a temperature in the range of 100° C. to 220° C., preferably in the range of 160° C. to 180° C. The vinylidene chloride copolymer-coated polyester monofilaments are then conveyed through a crosshead die in a direction perpendicular to the axis of the extruder that contains the molten coating material. After contacting the molten coating material at the exit of the crosshead die and passing through an air gap, the coated polyester monofilament is cooled. The coated monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage.

As a further example, the dried polyesters can be melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath and the solid filaments are then conveyed to a second bath containing either a solution or an aqueous emulsion of the vinylidene chloride copolymer and the coated solid filaments are then conveyed to a dryer whereby the solvent and/or water is removed. The vinylidene chloride copolymer coated monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The vinylidene chloride copolymer-coated polyester monofilaments are then conveyed through a crosshead die in a direction perpendicular to the axis of the extruder that contains the molten coating material. After contacting the molten coating material at the exit of the crosshead die and passing through an air gap, the coated polyester monofilament is cooled. The coated monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage.

As a further example, the dried polyesters can be melted at a temperature in the range of about 150° C. to about 300° C. Preferably, the polyesters are melted in the temperature range of about 170° C. to about 290° C. The spinning can generally be carried out by a spinning grid or an extruder. The extruder melts the dried granular polyester and conveys the melt to the spinning aggregate by a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester can be filtered through, for example, screen filters, to remove any particulate foreign matter. The molten polyester can then be conveyed, optionally through a metering pump, through a die to form the monofilament. After exiting the die, the monofilaments are quenched in a water bath. A solution or an aqueous emulsion of the vinylidene chloride copolymer is then pumped by a metering pump through nozzles and sprayed onto the polyester filament. The vinylidene chloride copolymer coated solid filaments are then conveyed to a dryer whereby the solvent and/or water is removed. The coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The vinylidene chloride copolymer-coated polyester monofilaments are then conveyed through a crosshead die in a direction perpendicular to the axis of the extruder that contains the molten coating material. After contacting the molten coating material at the exit of the crosshead die and passing through an air gap, the coated polyester monofilament is cooled. The coated monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage.

Preformed polyester monofilament can also be coated. For example, preformed polyester filament is removed from spools and conveyed into a bath containing either a solution or an aqueous emulsion of the vinylidene chloride copolymer. The coated polyester monofilament is then conveyed through a dryer and the solvent and/or water is removed. The vinylidene chloride-coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The vinylidene chloride copolymer coated polyester monofilament is then conveyed through a bath containing a solution or an aqueous emulsion of the coating material. The coated polyester monofilament is then conveyed through a dryer and the solvent and/or water is removed. These polyester monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. As a further example, preformed polyester filament is removed from spools and a solution or an aqueous emulsion of the vinylidene chloride copolymer is pumped through nozzles by a metering pump and sprayed onto the polyester monofilament. A solution or an aqueous emulsion of the coating material is then pumped by a metering pump through nozzles and sprayed onto the polyester monofilament. The coated polyester monofilament is then conveyed through a dryer and the solvent and/or water is removed. The polyester monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The coated polyester monofilaments are preferably heat set at a temperature in the range of 100° C. to 220° C., preferably in the range of 160° C. to 180° C.

For example, preformed polyester filament is removed from spools and conveyed into a bath containing either a solution or an aqueous emulsion of the vinylidene chloride copolymer. The coated polyester monofilament is then conveyed through a dryer to remove solvent and/or water. The vinylidene chloride copolymer coated polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The vinylidene chloride copolymer-coated polyester monofilaments are then conveyed through a crosshead die in a direction perpendicular to the axis of the extruder that contains the molten coating material. After contacting the molten coating material at the exit of the crosshead die and passing through an air gap, the coated polyester monofilament is cooled. The coated monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. As a further example, preformed polyester filament is removed from spools and a solution or an aqueous emulsion of the vinylidene chloride copolymer is pumped through nozzles by a metering pump and sprayed onto the polyester monofilament. The coated polyester monofilament is then conveyed through a dryer and the solvent and/or water is removed. The polyester monofilaments are preferably drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The vinylidene chloride-coated polyester monofilaments are preferably heat set at a temperature in the range of 100° C. to 220° C., preferably in the range of 160° C. to 180° C. The vinylidene chloride copolymer-coated polyester monofilaments are then conveyed through a crosshead die in a direction perpendicular to the axis of the extruder that contains the molten coating material. After contacting the molten coating material at the exit of the crosshead die and passing through an air gap, the coated polyester monofilament is cooled. The coated monofilaments can be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage.

Woven fabrics produced from polyester monofilaments by any conventional art processes can also be coated. For example, a woven textile fabric is conveyed through a bath containing either a solution or an aqueous emulsion of the vinylidene chloride copolymer. Preferably, the excess solution or emulsion contained within the interstices of the fabric is removed. This can be performed by passing the treated fabric over a vacuum box or by blowing it out with pressurized air or inert gases, such as nitrogen and the like. The coated woven textile fabric is then conveyed through a dryer and the solvent and/or water is removed. The vinylidene chloride-coated polyester monofilament woven textile fabric is preferably heat set at a temperature in the range of 100° C. to 220° C., preferably in the range of 160° C. to 180° C. The vinylidene chloride copolymer coated textile fabric is then conveyed through a bath containing a solution or an aqueous emulsion or dispersion of the coating material. Preferably, the excess solution, emulsion or dispersion contained within the interstices of the fabric is removed as described above. The coated textile fabric is then conveyed through a dryer and the solvent and/or water is removed. The processes can be simplified by conveying the woven textile fabric successively through baths containing the vinylidene chloride copolymer and the coating material. Preferably, the excess solutions, emulsions and/or dispersions are removed from the interstices of the fabric. The coated fabric can then be dried. The vinylidene chloride-coated polyester monofilament woven textile fabric is preferably heat set at a temperature in the range of 100° C. to 220° C., preferably in the range of 160° C. to 180° C.

As a further example, preformed woven textile fabric is sprayed with a solution or an aqueous emulsion of the vinylidene chloride copolymer, pumped through nozzles by a metering pump. Preferably, the excess solution or emulsion contained within the interstices of the fabric is removed as suggested above. The coated woven textile fabric is then conveyed through a dryer and the solvent and/or water is removed. The vinylidene chloride-coated polyester monofilament woven textile fabric is preferably heat set at a temperature in the range of 100° C. to 220° C., preferably in the range of 160° C. to 180° C. The coated fabric is then sprayed with a solution, emulsion or dispersion containing the coating material, pumped through nozzles by a metering pump. Preferably the excess solution, emulsion or dispersion of the coating materials is removed from the interstices of the fabric as suggested above. The coated fabric is then conveyed through a dryer and the solvent and/or water is removed. The processes can be simplified by spraying the woven textile fabric successively with solutions or emulsions containing the vinylidene chloride copolymer and solutions, emulsions or dispersions containing the coating material. Preferably, the excess solutions, emulsions and/or dispersions are removed from the interstices of the fabric. The coated fabric can then be dried. The coated polyester monofilament woven textile fabric is preferably heat set at a temperature in the range of 100° C. to 220° C., preferably in the range of 160° C. to 180° C.

The coated polyester monofilaments or fabrics can include from 0.01 to 10 weight percent of the vinylidene chloride copolymer and from 0.01 to 80 weight percent of the coating material based on the final weight of the coated polyester monofilament. Preferably, the coated polyester monofilaments or fabrics can include from 0.01 to 5 weight percent of the vinylidene chloride copolymer and 0.1 to 65 weight percent of the coating material based on the final weight of the coated polyester monofilament. More preferably, the coated polyester monofilaments or fabrics can include from 0.1 to 2.5 weight percent of the vinylidene chloride copolymer and 0.1 to 50 weight percent of the coating material based on the final weight of the coated polyester monofilament. The monofilaments are useful as reinforcements for rubbers, fishing lines, toothbrush bristles, paintbrush bristles and the like. When woven into fabrics, the monofilaments are useful in industrial belts and paper machine clothing.

EXAMPLES AND COMPARATIVE EXAMPLES

Test Methods

Inherent Viscosity, (IV), is defined in "Preparative Methods of Polymer Chemistry", W. R. Sorenson and T. W. Campbell, 1961, p. 35. It is determined at a concentration of 0.5 g./100 mL of a 50:50 weight percent trifluoroacetic acid:dichloromethane acid solvent system at room temperature by a Goodyear R-103B method.

Adhesion of the coating material to the core polyester monofilament can be tested in accordance with Federal Motor Vehicle Safety Standard 209, as modified as follows. The coated monofilament is clamped at one end and subjected to a reciprocating motion in a horizontal direction over a distance of 32 cm at a frequency of 0.5 Hz. To the other end of the coated monofilament is suspended a 1 oz. weight. At a point between the two ends of the coated monofilament, it passes through and bears against a fishing rod guide, ("Hardloy" silicon carbide guide by Fuji), of 8 mm diameter. As the coated monofilament passes through the guide, the direction of the line is changed from horizontal to vertical. The number of cycles of reciprocating motion are noted until there is visual observation of detachment of the coating material layer from the polyester core.

Preparative Example PE 1

To a 200 gallon autoclave is charged dimethyl terephthalate, (126.16 pounds), ethylene glycol, (78.0 pounds), manganese(II) acetate tetrahydrate, (37.65 grams), and antimony (III) trioxide, (13.6 grams). The autoclave is purged three times with nitrogen and heated to 245° C. over 4.5 hours with stirring. Over this heating cycle, distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Preparative Example PE 2

A portion of the material produced in Preparative Example PE 1 is subjected to solid phase polymerization at a temperature of 230° C. until the polymer is tested for inherent viscosity, as described above and is found to have an IV of 0.72 dL/g.

Preparative Example PE 3

A portion of the material produced in Preparative Example PE 1 is subjected to solid phase polymerization at a temperature of 230° C. until the polymer is tested for inherent viscosity, as described above and is found to have an IV of 0.83 dL/g.

Preparative Example PE 4

A portion of the material produced in Preparative Example PE 1 is subjected to solid phase polymerization at a temperature of 230° C. until the polymer is tested for inherent viscosity, as described above and is found to have an IV of 0.95 dL/g.

Preparative Example PE 5

To a 200 gallon autoclave is charged dimethyl terephthalate, (126.16 pounds), trimellitic anhydride, (1,2,4-benzenetricarboxylic anhydride), (0.0936 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Preparative Example PE 6

To a 200 gallon autoclave is charged dimethyl terephthalate, (126.16 pounds), pentaerythritol, (0.0624 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.60 dL/g.

Preparative Example PE 7

To a 200 gallon autoclave is charged dimethyl terephthalate, (122.38 pounds), dimethyl isophthalate, (3.78 pounds), ethylene glycol, (78.0 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.60 dL/g.

Preparative Example PE 8

A portion of the material produced in Preparative Example PE 7 is subjected to solid phase polymerization at a temperature of 230° C. until the polymer is tested for inherent viscosity, as described above and is found to have an IV of 0.83 dL/g.

Preparative Example PE 9

To a 200 gallon autoclave is charged dimethyl terephthalate, (126.16 pounds), ethylene glycol, (78.0 pounds), 1,4-cyclohexanedimethanol, (1.87 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Preparative Example PE 10

A portion of the material produced in Preparative Example PE 9 is subjected to solid phase polymerization at a temperature of 230° C. until the polymer is tested for inherent viscosity, as described above and is found to have an IV of 0.85 dL/g.

Preparative Example PE 11

To a 200 gallon autoclave is charged dimethyl terephthalate, (126.16 pounds), 1,3-propanediol, (64.27 pounds), and titanium(IV) isopropoxide, (72.10 grams). The autoclave is purged three times with nitrogen and heated to 225° C. over 4.5 hours with stirring. Over this heating cycle, distillate is recovered. With continued heating and stirring, vacuum is staged onto the autoclave over 1.5 hours. The resulting reaction mixture is stirred at 255° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.90 dL/g.

Preparative Example PE 12

To a 200 gallon autoclave is charged dimethyl terephthalate, (126.16 pounds), 1,4-butanediol, (76.11 pounds), and titanium(IV) isopropoxide, (77.00 grams). The autoclave is purged three times with nitrogen and heated to 225° C. over 4.5 hours with stirring. Over this heating cycle, distillate is recovered. With continued heating and stirring, vacuum is staged onto the autoclave over 1.5 hours. The resulting reaction mixture is stirred at 255° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.75 dL/g.

Preparative Example PE 13

To a 200 gallon autoclave is charged dimethyl terephthalate, (63.08 pounds), ethylene glycol, (39.0 pounds), poly (ethylene glycol), (average molecular weight of 2000, 62.37 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.80 dL/g.

Preparative Example PE 14

To a 200 gallon autoclave is charged dimethyl terephthalate, (31.54 pounds), 1,3-propanediol, (16.07 pounds), poly (ethylene glycol)-block-poly(propylene glycol)-block-poly (ethylene glycol), (average molecular weight=2,800, 10 weight percent ethylene glycol, 100.37 pounds), and titanium(IV) isopropoxide, (72.10 grams). The autoclave is purged three times with nitrogen and heated to 225° C. over 4.5 hours with stirring. Over this heating cycle, distillate is recovered. With continued heating and stirring, vacuum is staged onto the autoclave over 1.5 hours. The resulting reaction mixture is stirred at 255° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 1.20 dL/g.

Preparative Example PE 15

To a 200 gallon autoclave is charged dimethyl terephthalate, (107.24 pounds), 1,4-butanediol, (64.69 pounds), poly (tetramethylene ether)glycol, (average molecular weight=2000, 21.44 pounds), and titanium(IV) isopropoxide, (77.00 grams). The autoclave is purged three times with nitrogen and heated to 225° C. over 4.5 hours with stirring. Over this heating cycle, distillate is recovered. With continued heating and stirring, vacuum is staged onto the autoclave over 1.5 hours. The resulting reaction mixture is stirred at 255° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.85 dL/g.

Preparative Example PE 16

The polyester produced in Preparative Example PE 3 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

Comparative Example CE 1

The polyester monofilament produced as described in Preparative Example PE 16 is unwound from the spool and passed through a bath containing a 5 weight percent solids aqueous latex of polyurethane. The nascent coated monofilament is then conveyed through a dryer at about 100° C. and taken up on spools for testing.

The coated monofilament is tested for adhesion as described above.

Example 1

The polyester monofilament produced as described in Preparative Example PE 16 is unwound from the spool and passed through a bath containing a 0.1 weight percent solids aqueous dispersion of a vinylidene chloride/methyl acrylate/itaconic acid copolymer, (90:10:2 weight percent, produced as described in Alles et al., in U.S. Pat. No. 2,627,088, Example 1, column 5, line 26, as diluted with water to 0.1 weight percent total solids). The nascent vinylidene chloride copolymer coated polyester monofilament is conveyed through a dryer at about 100° C., passed through draw rolls at a temperature of 80° C. and stretched to a draw ratio of 3:1, passed through a second dryer and heat set at a temperature of 160° C., and then through a second bath containing a 5 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 2

The polyester monofilament produced as described in Preparative Example PE 16 is unwound from the spool and passed through a bath containing a 0.5 weight percent solids aqueous dispersion of a vinylidene chloride/methyl acrylate/itaconic acid copolymer, (90:10:2 weight percent, produced as described in Alles et al., in U.S. Pat. No. 2,627,088, Example 1, column 5, line 26, as diluted with water to 0.5 weight percent total solids). The nascent vinylidene chloride copolymer coated polyester monofilament is conveyed through a dryer at about 100° C., passed through draw rolls at a temperature of 90° C. and stretched to a draw ratio of 4:1, passed through a second dryer and heat set at a temperature of 180° C., and then through a second bath containing a 5 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 3

The polyester monofilament produced as described in Preparative Example PE 16 is unwound from the spool and passed through a bath containing a 1 weight percent solids aqueous dispersion of a vinylidene chloride/methyl acrylate/itaconic acid copolymer, (90:10:2 weight percent, produced as described in Alles et al., in U.S. Pat. No. 2,627,088, Example 1, column 5, line 26, as diluted with water to 0.1 weight percent total solids). The nascent vinylidene chloride copolymer coated polyester monofilament is conveyed through a dryer at about 100° C., passed through draw rolls at a temperature of 80° C. and stretched to a draw ratio of 4:1, passed through a second dryer and heat set at a temperature of 170° C., and then through a second bath containing a 5 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 4

The polyester monofilament produced as described in Preparative Example PE 16 is unwound from the spool and passed through a bath containing a 1 weight percent solids aqueous dispersion of a vinylidene chloride/methyl acrylate/itaconic acid copolymer, (90:10:2 weight percent, produced as described in Alles et al., in U.S. Pat. No. 2,627,088, Example 1, column 5, line 26, as diluted with water to 1 weight percent total solids). The nascent vinylidene chloride copolymer monofilament is conveyed through a second bath containing a 5 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 5

The polyester monofilament produced as described in Preparative Example PE 16 is unwound from the spool and passed through a bath containing a 0.1 weight percent solids aqueous emulsion containing a mixture comprised of 70 weight percent of a vinylidene chloride/methyl acrylate/itaconic acid copolymer, (90:10:2 weight percent) and 30 weight percent of a poly(ethyl acrylate), (produced as described in Cohen in U.S. Pat. No. 3,460,944, Example 1, column 4, line 66, as diluted with water to 0.1 weight percent total solids). The nascent vinylidene chloride copolymer coated polyester monofilament is conveyed through a dryer at about 100° C., passed through draw rolls at a temperature of 80° C. and stretched to a draw ratio of 4:1, passed through a second dryer and heat set at a temperature of 170° C., and then through a second bath containing a 5 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 6

The polyester monofilament produced as described in Preparative Example PE 16 is unwound from the spool and passed through a bath containing a 1.0 weight percent solids aqueous emulsion containing a mixture comprised of 70 weight percent of a vinylidene chloride/methyl acrylate/itaconic acid copolymer, (90:10:2 weight percent) and 30 weight percent of a poly(ethyl acrylate), (produced as described in Cohen in U.S. Pat. No. 3,460,944, Example 1, column 4, line 66, as diluted with water to 1.0 weight percent total solids). The nascent vinylidene chloride copolymer coated polyester monofilament is conveyed through a dryer at about 100° C., passed through draw rolls at a temperature of 70° C. and stretched to a draw ratio of 3.0:1, passed through a second dryer and heat set at a temperature of 160° C., and then through a second bath containing a 5 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 7

The polyester monofilament produced as described in Preparative Example PE 16 is unwound from the spool and passed through a bath containing a 2.5 weight percent solids aqueous emulsion containing a mixture comprised of 70 weight percent of a vinylidene chloride/methyl acrylate/itaconic acid copolymer, (90:10:2 weight percent) and 30 weight percent of a poly(ethyl acrylate), (produced as described in Cohen in U.S. Pat. No. 3,460,944, Example 1, column 4, line 66, as diluted with water to 2.5 weight percent total solids). The nascent vinylidene chloride copolymer coated polyester monofilament is conveyed through a dryer at about 100° C., passed through draw rolls at a temperature of 80° C. and stretched to a draw ratio of 3.5:1, passed through a second dryer and heat set at a temperature of 170° C., and then through a second bath containing a 5 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 8

The polyester monofilament produced as described in Preparative Example PE 16 is unwound from the spool and passed through a bath containing a 5 weight percent solids aqueous emulsion containing a mixture comprised of 70 weight percent of a vinylidene chloride/methyl acrylate/itaconic acid copolymer, (90:10:2 weight percent) and 30 weight percent of a poly(ethyl acrylate), (produced as described in Cohen in U.S. Pat. No. 3,460,944, Example 1, column 4, line 66, as diluted with water to 5 weight percent total solids). The nascent vinylidene chloride copolymer coated polyester monofilament is conveyed through a second bath containing a 5 weight percent solids aqueous latex of polyurethane. The nascent coated monofilament is then conveyed through a dryer at about 100° C., passed through draw rolls at a temperature of 70° C. and stretched to a draw ratio of 3:1, passed through a second dryer and heat set at a temperature of 160° C., and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 9

The polyester monofilament produced as described in Preparative Example PE 16 is unwound from the spool and passed through a bath containing a 0.1 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 0.1 weight percent total solids). The nascent vinylidene chloride copolymer coated polyester monofilament is conveyed through a dryer at about 100° C., passed through draw rolls at a temperature of 80° C. and stretched to a draw ratio of 3.5:1, passed through a second dryer and heat set at a temperature of 170° C., and then through a second bath containing a 5 weight percent solids aqueous latex of polyurethane. The nascent coated monofilament is then conveyed through a dryer at about 100° C., and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 10

The polyester monofilament produced as described in Preparative Example PE 16 is unwound from the spool and passed through a bath containing a 1.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 1.0 weight percent total solids). The nascent vinylidene chloride copolymer coated polyester monofilament is conveyed through a dryer at about 100° C., passed through draw rolls at a temperature of 70° C. and stretched to a draw ratio of 3:1, passed through a second dryer and heat set at a temperature of 170° C., and then through a second bath containing a 5 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 11

The polyester monofilament produced as described in Preparative Example PE 16 is unwound from the spool and passed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The nascent vinylidene chloride copolymer coated polyester monofilament is conveyed through a dryer at about 100° C., passed through draw rolls at a temperature of 80° C. and stretched to a draw ratio of 3.5:1, passed through a second dryer and heat set at a temperature of 170° C., and then through a second bath containing a 5 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 12

The polyester monofilament produced as described in Preparative Example PE 16 is unwound from the spool and passed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The nascent vinylidene chloride copolymer coated polyester monofilament is conveyed through a dryer at about 100° C., passed through draw rolls at a temperature of 70° C. and stretched to a draw ratio of 3:1, passed through a second dryer and heat set at a temperature of 180° C., and then through a second bath containing a 10.0 weight percent solids aqueous latex of polyurethane. The nascent coated monofilament is then conveyed through a dryer at about 100° C. and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Example 13

The polyester monofilament produced as described in Preparative Example PE 16 is unwound from the spool and passed through a bath containing a 25.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 25.0 weight percent total solids). The nascent vinylidene chloride copolymer coated polyester monofilament is conveyed through a second bath containing a 25.0 weight percent solids aqueous latex of polyurethane. The nascent coated monofilament is then conveyed through a dryer at about 100° C., passed through draw rolls at a temperature of 80° C. and stretched to a draw ratio of 3.5:1, passed through a second dryer and heat set at a temperature of 170° C., and taken up on spools for testing.

The coated monofilament is tested for adhesion as described above and is found to survive greater than 10 percent more cycles than found for the coated monofilament prepared in Comparative Example CE 1 until there is visual observation of detachment of the coating material layer from the polyester core.

Comparative Example CE 2

The polyester produced in Preparative Example PE 2 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a dryer at about 100° C., passed through draw rolls at a temperature of 80° C. and stretched to a draw ratio of 3.5:1, passed through a second dryer and heat set at a temperature of 170° C., and a second bath containing a 10 weight percent solution of ELVAMIDE® 8061 in a solvent mixture consisting of 85 weight percent methanol and 15 weight percent of water. ELVAMIDE® 8061 is a commercial product of the DuPont Company and is a nylon multipolymer. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The coated monofilament is tested for adhesion as described above.

Example 14

The polyester produced in Preparative Example PE 2 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a bath containing a 10.0 weight percent solids aqueous emulsion of a vinylidene chloride/methyl acrylate/itaconic acid copolymer, (90:10:2 weight percent, produced as described in Alles et al., in U.S. Pat. No. 2,627,088, Example 1, column 5, line 26, as diluted with water to 10.0 weight percent total solids), at a temperature of 66° C., positioned 2.0 cm under the die. The monofilament is then conveyed through a dryer at about 100° C., passed through draw rolls at a temperature of 80° C. and stretched to a draw ratio of 3.5:1, passed through a second dryer and heat set at a temperature of 170° C., and a second bath containing a 10 weight percent solution of ELVAMIDE® 8061 in a solvent mixture consisting of 85 weight percent methanol and 15 weight percent of water. ELVAMIDE® 8061 is a commercial product of the DuPont Company and is a nylon multipolymer. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The coated monofilament is tested for adhesion as described above and is found to survive greater than 10 percent more cycles than found for the coated monofilament prepared in Comparative Example CE 2 until there is visual observation of detachment of the coating material layer from the polyester core.

Example 15

The polyester produced in Preparative Example PE 2 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a bath containing a 10.0 weight percent solids aqueous emulsion containing a mixture comprised of 70 weight percent of a vinylidene chloride/methyl acrylate/itaconic acid copolymer, (90:10:2 weight percent) and 30 weight percent of a poly(ethyl acrylate), (produced as described in Cohen in U.S. Pat. No. 3,460,944, Example 1, column 4, line 66, as diluted with water to 10.0 weight percent total solids), at a temperature of 66° C., positioned 2.0 cm under the die. The monofilament is then conveyed through a dryer at about 100° C., passed through draw rolls at a temperature of 80° C. and stretched to a draw ratio of 3.5:1, passed through a second dryer and heat set at a temperature of 170° C., and a second bath containing a 10 weight percent solution of ELVAMIDE® 8061 in a solvent mixture consisting of 85 weight percent methanol and 15 weight percent of water. ELVAMIDE® 8061 is a commercial product of the DuPont Company and is a nylon multipolymer. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The coated monofilament is tested for adhesion as described above and is found to survive greater than 10 percent more cycles than found for the coated monofilament prepared in Comparative Example CE 2 until there is visual observation of detachment of the coating material layer from the polyester core.

Example 16

The polyester produced in Preparative Example PE 2 is dried at 160° C. for at least 6 hours. The dried polyester is then placed in an extruder hopper and extruded. The extrusion conditions, which are not considered limiting, are:
First Heater Zone Temperature: 260° C.
Second Heater Zone Temperature: 275° C.
Third Heater Zone Temperature: 275° C.
Extruder Die Temperature: 285° C.

The extruder die had eight 0.80 mm holes. The final monofilament size was 0.30 mm. The monofilament was quenched in a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids), at a temperature of 66° C., positioned 2.0 cm under the die. The monofilament is then conveyed through a dryer at about 100° C., passed through draw rolls at a temperature of 70° C. and stretched to a draw ratio of 3:1, passed through a second dryer and heat set at a temperature of 160° C., and a second bath containing a 10 weight percent solution of ELVAMIDE® 8061 in a solvent mixture consisting of 85 weight percent methanol and 15 weight percent of water. ELVAMIDE® 8061 is a commercial product of the DuPont Company and is a nylon multipolymer. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The coated monofilament is tested for adhesion as described above and is found to survive greater than 10 percent more cycles than found for the coated monofilament prepared in Comparative Example CE 2 until there is visual observation of detachment of the coating material layer from the polyester core.

Example 17

The polyester produced in Preparative Example PE 2 is dried at 160° C. for at least 6 hours. The dried polyester is then placed in an extruder hopper and extruded. The extrusion conditions, which are not considered limiting, are:
First Heater Zone Temperature: 260° C.
Second Heater Zone Temperature: 275° C.
Third Heater Zone Temperature: 275° C.
Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The monofilament is then conveyed through a dryer at about 100° C., passed through draw rolls at a temperature of 70° C. and stretched to a draw ratio of 3:1, passed through a second dryer and heat set at a temperature of 180° C., and a second bath containing a 10 weight percent solution of ELVAMIDE® 8061 in a solvent mixture consisting of 85 weight percent methanol and 15 weight percent of water. ELVAMIDE® 8061 is a commercial product of the DuPont Company and is a nylon multipolymer. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The coated monofilament is tested for adhesion as described above and is found to survive greater than 10 percent more cycles than found for the coated monofilament prepared in Comparative Example CE 2 until there is visual observation of detachment of the coating material layer from the polyester core.

Example 18

The polyester produced in Preparative Example PE 2 is dried at 160° C. for at least 6 hours. The dried polyester is then placed in an extruder hopper and extruded. The extrusion conditions, which are not considered limiting, are:
First Heater Zone Temperature: 260° C.
Second Heater Zone Temperature: 275° C.
Third Heater Zone Temperature: 275° C.
Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The vinylidene chloride copolymer coated monofilament is passed through a drying oven at 100° C. where the water is removed, passed through draw rolls at a temperature of 90° C. and stretched to a draw ratio of 4:1, and passed through a second dryer and heat set at a temperature of 160° C. The monofilament is then conveyed through a second bath containing a 10 weight percent solution of ELVAMIDE® 8061 in a solvent mixture consisting of 85 weight percent methanol and 15 weight percent of water. ELVAMIDE® 8061 is a commercial product of the DuPont Company and is a nylon multipolymer. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The coated monofilament is tested for adhesion as described above and is found to survive greater than 10 percent more cycles than found for the coated monofilament prepared in Comparative Example CE 2 until there is visual observation of detachment of the coating material layer from the polyester core.

Example 19

The polyester produced in Preparative Example PE 2 is dried at 160° C. for at least 6 hours. The dried polyester is then placed in an extruder hopper and extruded. The extrusion conditions, which are not considered limiting, are:

First Heater Zone Temperature: 260° C.
Second Heater Zone Temperature: 275° C.
Third Heater Zone Temperature: 275° C.
Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. A 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids) is pumped by a metering pump, through spray nozzles and is sprayed onto the monofilament. The monofilament is then conveyed through a second bath containing a 10 weight percent solution of ELVAMIDE® 8061 in a solvent mixture consisting of 85 weight percent methanol and 15 weight percent of water. ELVAMIDE® 8061 is a commercial product of the DuPont Company and is a nylon multipolymer. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The coated monofilament is tested for adhesion as described above and is found to survive greater than 10 percent more cycles than found for the coated monofilament prepared in Comparative Example CE 2 until there is visual observation of detachment of the coating material layer from the polyester core.

Example 20

The polyester produced in Preparative Example PE 5 is dried at 160° C. for at least 6 hours. The dried polyester is then placed in an extruder hopper and extruded. The extrusion conditions, which are not considered limiting, are:
First Heater Zone Temperature: 260° C.
Second Heater Zone Temperature: 275° C.
Third Heater Zone Temperature: 275° C.
Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The monofilament is then conveyed through a second bath containing a 10 weight percent solution of ELVAMIDE® 8061 in a solvent mixture consisting of 85 weight percent methanol and 15 weight percent of water. ELVAMIDE® 8061 is a commercial product of the DuPont Company and is a nylon multipolymer. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

Example 21

The polyester produced in Preparative Example PE 8 is dried at 160° C. for at least 6 hours. The dried polyester is then placed in an extruder hopper and extruded. The extrusion conditions, which are not considered limiting, are:
First Heater Zone Temperature: 260° C.
Second Heater Zone Temperature: 275° C.
Third Heater Zone Temperature: 275° C.
Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The monofilament is then conveyed through a second bath containing a 10 weight percent solution of ELVAMIDE® 8061 in a solvent mixture consisting of 85 weight percent methanol and 15 weight percent of water. ELVAMIDE® 8061 is a commercial product of the DuPont Company and is a nylon multipolymer. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

Example 22

The polyester produced in Preparative Example PE 10 is dried at 160° C. for at least 6 hours. The dried polyester is then placed in an extruder hopper and extruded. The extrusion conditions, which are not considered limiting, are:
First Heater Zone Temperature: 260° C.
Second Heater Zone Temperature: 275° C.
Third Heater Zone Temperature: 275° C.
Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The monofilament is then conveyed through a second bath containing a 15 weight percent aqueous solution of poly (vinyl alcohol). The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

Example 23

The polyester produced in Preparative Example PE 11 is dried at 130° C. for at least 6 hours. The dried polyester is then placed in an extruder hopper and extruded. The extrusion conditions, which are not considered limiting, are:
First Heater Zone Temperature: 235° C.
Second Heater Zone Temperature: 250° C.
Third Heater Zone Temperature: 250° C.
Extruder Die Temperature: 255° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The monofilament is then conveyed through a second bath containing a 15 weight percent aqueous solution of poly (vinyl pyrrolidone). The quenched monofilament is drawn in a hot air oven at a temperature of 74° C. with a draw ratio of 3.36, drawn further in a hot air oven at a temperature of 200° C. to a total draw ratio of 5.0 and allowed to relax 25 percent at a temperature of 170° C. The finished monofilament is then taken up on spools for testing.

Example 24

The polyester produced in Preparative Example PE 12 is dried at 120° C. for at least 6 hours. The dried polyester is then placed in an extruder hopper and extruded. The extrusion conditions, which are not considered limiting, are:
First Heater Zone Temperature: 230° C.
Second Heater Zone Temperature: 245° C.
Third Heater Zone Temperature: 245° C.
Extruder Die Temperature: 250° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The monofilament is then conveyed through a second bath containing a 15 weight percent aqueous solution of poly (acrylic acid). The quenched monofilament is drawn in a hot air oven at a temperature of 74° C. with a draw ratio of 3.36, drawn further in a hot air oven at a temperature of 200° C. to a total draw ratio of 5.0 and allowed to relax 25 percent at a temperature of 170° C. The finished monofilament is then taken up on spools for testing.

Example 25

The polyester produced in Preparative Example PE 13 is dried at 60° C. for at least 6 hours. The dried polyester is then placed in an extruder hopper and extruded. The extrusion conditions, which are not considered limiting, are:
First Heater Zone Temperature: 180° C.
Second Heater Zone Temperature: 190° C.
Third Heater Zone Temperature: 190° C.
Extruder Die Temperature: 195° C.

The extruder die had eight 0.80 mm holes. The final monofilament size was 0.30 mm. The monofilament was quenched in a water bath at room temperature, positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The monofilament is then conveyed through a second bath containing a 15 weight percent aqueous emulsion of oxidized polyethylene. The quenched monofilament is drawn in a hot air oven at a temperature of 50° C. with a draw ratio of 3.36, drawn further in a hot air oven at a temperature of 100° C. to a total draw ratio of 5.0 and allowed to relax 25 percent at a temperature of 170° C. The finished monofilament is then taken up on spools for testing.

Example 26

The polyester produced in Preparative Example PE 14 is dried at 60° C. for at least 6 hours. The dried polyester is then placed in an extruder hopper and extruded. The extrusion conditions, which are not considered limiting, are:
First Heater Zone Temperature: 180° C.
Second Heater Zone Temperature: 190° C.
Third Heater Zone Temperature: 190° C.
Extruder Die Temperature: 195° C.

The extruder die had eight 0.80 mm holes. The final monofilament size was 0.30 mm. The monofilament was quenched in a water bath at room temperature, positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The monofilament is then conveyed through a second bath containing a 15 weight percent methanolic solution of poly(vinyl butyral-co-vinyl alcohol-co-vinyl acetate). The quenched monofilament is drawn in a hot air oven at a temperature of 50° C. with a draw ratio of 3.36, drawn further in a hot air oven at a temperature of 100° C. to a total draw ratio of 5.0 and allowed to relax 25 percent at a temperature of 170° C. The finished monofilament is then taken up on spools for testing.

Example 27

The polyester produced in Preparative Example PE 15 is dried at 120° C. for at least 6 hours. The dried polyester is then placed in an extruder hopper and extruded. The extrusion conditions, which are not considered limiting, are:
First Heater Zone Temperature: 230° C.
Second Heater Zone Temperature: 245° C.

Third Heater Zone Temperature: 245° C.

Extruder Die Temperature: 250° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The monofilament is then conveyed through a second bath containing a 15 weight percent aqueous emulsion of polyurethane. The quenched monofilament is drawn in a hot air oven at a temperature of 74° C. with a draw ratio of 3.36, drawn further in a hot air oven at a temperature of 200° C. to a total draw ratio of 5.0 and allowed to relax 25 percent at a temperature of 170° C. The finished monofilament is then taken up on spools for testing.

Example 28

The polyester produced in Preparative Example PE 4 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. A 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids) is pumped by a metering pump, through spray nozzles and is sprayed onto the monofilament. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C.

Polyethylene, with a melting point of 135° C., is fed to a single screw extruder, (diameter of 2.54 cm and a 25:1 L/D), fitted with a crosshead die of 0.107 cm exit diameter. The extruder has a flat temperature profile of 155° C., with a feed section temperature of 130° C. and a die temperature of 160° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 100° C., dried and wound up on spools.

Example 29

The polyester produced in Preparative Example PE 4 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. A 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids) is pumped by a metering pump, through spray nozzles and is sprayed onto the monofilament. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C.

Polyethylene, with a melting point of 100° C., is fed to a single screw extruder, (diameter of 2.54 cm and a 25:1 L/D), fitted with a crosshead die of 0.107 cm exit diameter. The extruder has a flat temperature profile of 125° C., with a feed section temperature of 100° C. and a die temperature of 130° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 80° C., dried and wound up on spools.

Example 30

The polyester produced in Preparative Example PE 4 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. A 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids) is pumped by a metering pump, through spray nozzles and is sprayed onto the monofilament. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C.

The polyester produced in Preparative Example PE 11 is fed to a single screw extruder, (diameter of 2.54 cm and a 25:1 L/D), fitted with a crosshead die of 0.107 cm exit diameter. The extruder has a flat temperature profile of 250° C., with a feed section temperature of 230° C. and a die temperature of 255° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 100° C., dried and wound up on spools.

Example 31

The polyester produced in Preparative Example PE 4 is dried at 160° C. for at least 6 hours. The dried polyester is then placed in an extruder hopper and extruded. The extrusion conditions, which are not considered limiting, are:
First Heater Zone Temperature: 260° C.
Second Heater Zone Temperature: 275° C.
Third Heater Zone Temperature: 275° C.
Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. A 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids) is pumped by a metering pump, through spray nozzles and is sprayed onto the monofilament. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C.

Poly(2,6-dimethylphenylene oxide) is fed to a single screw extruder, (diameter of 2.54 cm and a 25:1 L/D), fitted with a crosshead die of 0.107 cm exit diameter. The extruder has a flat temperature profile of 210° C., with a feed section temperature of 190° C. and a die temperature of 215° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 100° C., dried and wound up on spools.

Example 32

The polyester produced in Preparative Example PE 4 is dried at 160° C. for at least 6 hours. The dried polyester is then placed in an extruder hopper and extruded. The extrusion conditions, which are not considered limiting, are:
First Heater Zone Temperature: 260° C.
Second Heater Zone Temperature: 275° C.
Third Heater Zone Temperature: 275° C.
Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. A 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids) is pumped by a metering pump, through spray nozzles and is sprayed onto the monofilament. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C.

Poly(phenylene sulfide) is fed to a single screw extruder, (diameter of 2.54 cm and a 25:1 L/D), fitted with a crosshead die of 0.107 cm exit diameter. The extruder has a flat temperature profile of 310° C., with a feed section temperature of 290° C. and a die temperature of 315° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 100° C., dried and wound up on spools.

Example 33

The polyester produced in Preparative Example PE 15 is dried at 120° C. for at least 6 hours. The dried polyester is then placed in an extruder hopper and extruded. The extrusion conditions, which are not considered limiting, are:
First Heater Zone Temperature: 230° C.
Second Heater Zone Temperature: 245° C.
Third Heater Zone Temperature: 245° C.
Extruder Die Temperature: 250° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The vinylidene chloride copolymer coated monofilament is drawn in a hot air oven at a temperature of 74° C. with a draw ratio of 3.36, drawn further in a hot air oven at a temperature of 200° C. to a total draw ratio of 5.0 and allowed to relax 25 percent at a temperature of 170° C.

Polypropylene is fed to a single screw extruder, (diameter of 2.54 cm and a 25:1 L/D), fitted with a crosshead die of 0.107 cm exit diameter. The extruder has a flat temperature profile of 195° C., with a feed section temperature of 155° C. and a die temperature of 200° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 100° C., dried and wound up on spools.

Example 34

The polyester produced in Preparative Example PE 15 is dried at 120° C. for at least 6 hours. The dried polyester is then placed in an extruder hopper and extruded. The extrusion conditions, which are not considered limiting, are:
First Heater Zone Temperature: 230° C.
Second Heater Zone Temperature: 245° C.
Third Heater Zone Temperature: 245° C.
Extruder Die Temperature: 250° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The vinylidene chloride copolymer coated monofilament is drawn in a hot air oven at a temperature of 74° C. with a draw ratio of 3.36, drawn further in a hot air oven at a temperature of 200° C. to a total draw ratio of 5.0 and allowed to relax 25 percent at a temperature of 170° C.

Thermoplastic polyurethane, with a melting point of 100° C., is fed to a single screw extruder, (diameter of 2.54 cm and a 25:1 L/D), fitted with a crosshead die of 0.107 cm exit diameter. The extruder has a flat temperature profile of 125° C., with a feed section temperature of 105° C. and a die temperature of 130° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 80° C., dried and wound up on spools.

Example 35

The polyester produced in Preparative Example PE 15 is dried at 120° C. for at least 6 hours. The dried polyester is then placed in an extruder hopper and extruded. The extrusion conditions, which are not considered limiting, are:
First Heater Zone Temperature: 230° C.
Second Heater Zone Temperature: 245° C.
Third Heater Zone Temperature: 245° C.
Extruder Die Temperature: 250° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The vinylidene chloride copolymer coated monofilament is drawn in a hot air oven at a temperature of 74° C. with a draw ratio of 3.36, drawn further in a hot air oven at a temperature of 200° C. to a total draw ratio of 5.0 and allowed to relax 25 percent at a temperature of 170° C.

Polyvinylidene chloride is fed to a single screw extruder, (diameter of 2.54 cm and a 25:1 L/D), fitted with a crosshead die of 0.107 cm exit diameter. The extruder has a flat temperature profile of 195° C., with a feed section temperature of 155° C. and a die temperature of 200° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 100° C., dried and wound up on spools.

Example 36

The polyester produced in Preparative Example PE 15 is dried at 120° C. for at least 6 hours. The dried polyester is then placed in an extruder hopper and extruded. The extrusion conditions, which are not considered limiting, are:
First Heater Zone Temperature: 230° C.
Second Heater Zone Temperature: 245° C.
Third Heater Zone Temperature: 245° C.
Extruder Die Temperature: 250° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The vinylidene chloride copolymer coated monofilament is drawn in a hot air oven at a temperature of 74° C. with a draw ratio of 3.36, drawn further in a hot air oven at a temperature of 200° C. to a total draw ratio of 5.0 and allowed to relax 25 percent at a temperature of 170° C.

Polyvinylidene fluoride is fed to a single screw extruder, (diameter of 2.54 cm and a 25:1 L/D), fitted with a crosshead die of 0.107 cm exit diameter. The extruder has a flat temperature profile of 195° C., with a feed section temperature of 155° C. and a die temperature of 200° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 100° C., dried and wound up on spools.

Example 37

The polyester produced in Preparative Example PE 15 is dried at 120° C. for at least 6 hours. The dried polyester is then placed in an extruder hopper and extruded. The extrusion conditions, which are not considered limiting, are:

First Heater Zone Temperature: 230° C.

Second Heater Zone Temperature: 245° C.

Third Heater Zone Temperature: 245° C.

Extruder Die Temperature: 250° C.

The extruder die had eight 0.80 mm holes. The final monofilament size was 0.30 mm. The monofilament was quenched in a water bath at a temperature of 66° C., positioned 2.0 cm under the die. The monofilament is then conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids). The vinylidene chloride copolymer coated monofilament is drawn in a hot air oven at a temperature of 74° C. with a draw ratio of 3.36, drawn further in a hot air oven at a temperature of 200° C. to a total draw ratio of 5.0 and allowed to relax 25 percent at a temperature of 170° C.

Plasticized polyvinyl chloride is fed to a single screw extruder, (diameter of 2.54 cm and a 25:1 L/D), fitted with a crosshead die of 0.107 cm exit diameter. The extruder has a flat temperature profile of 125° C., with a feed section temperature of 100° C. and a die temperature of 130° C. The polymer is melted and conveyed by the extruder screw to the crosshead vacuum die. The above described vinylidene chloride copolymer coated polyester monofilament is fed transverse through the crosshead die in a direction perpendicular to the axis of the extruder. The design of the crosshead die is such that the extruded polymer melt contacted the yarn and the vacuum aided in pulling the melt into contact with the monofilament. After contacting the polymer melt at the exit of the crosshead die, the coated polyester monofilament passes through an air gap of 20 cm and is quenched in a water bath. The coated monofilament is conveyed through an oven at 80° C., dried and wound up on spools.

Preparative Example PE 17

The polyester produced in Preparative Example PE 6 is dried at 160° C. for at least 6 hours. The dried polyester is then placed in an extruder hopper and extruded. N,N'-di-2,6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The polyester monofilament is woven into a paper machine clothing textile fabric through conventional art processes.

Preparative Example PE 18

The polyester produced in Preparative Example PE 4 is dried at 160° C. for at least 6 hours. The dried polyester is then placed in an extruder hopper and extruded. N,N'-di-2,6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The polyester monofilament is woven into a paper machine clothing textile fabric through conventional art processes.

Example 38

The textile fabric produced as described in Preparative Example PE 17 is sprayed with a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids), by a metering pump through spray nozzles. The vinylidene chloride copolymer coated polyester monofilament textile fabric is then sprayed with a 15 weight percent aqueous dispersion of a fluorinated polyacrylate ester through spray nozzles and the treated fabric is conveyed to an oven at 180° C. and dried and heat set.

Example 39

The textile fabric produced as described in Preparative Example PE 18 is conveyed through a bath containing a 10.0 weight percent solids aqueous emulsion containing a mixture comprised of 75 weight percent of a vinylidene chloride/methyl acrylate/itaconic acid copolymer, (90:10:2 weight percent) and 25 weight percent of a poly(ethyl acrylate), (produced by sequential polymerization as described in Rawlins in U.S. Pat. No. 3,443,950, Procedure A, column 3, line 59, as diluted with water to 10.0 weight percent total solids), and then passed over a vacuum box to remove the excess emulsion within the interstices of the fabric. The vinylidene chloride copolymer coated polyester monofilament textile fabric is conveyed to an oven at 100° C. and dried. The fabric is then conveyed through a bath containing a 15 weight percent aqueous polyurethane latex and then passed over a vacuum box to remove the excess latex within the interstices of the fabric. The coated fabric is then conveyed through an oven at 160° C. and dried and heat set.

What is claimed is:

1. A monofilament comprising a polyester core and a core coating, said core coating comprising a vinylidene chloride copolymer, wherein the monofilament is drawn at a draw ratio of about 3.0:1 to about 4.5:1 and is heated to a temperature up to about 100° C., and further wherein the drawn monofilament is heat set at a temperature in the range of 100° C. to 220° C.

2. The monofilament of claim 1 wherein said vinylidene chloride copolymer comprises from about 35 to about 96 weight percent vinylidene chloride and from about 4 to about 65 weight percent of at least one other polymerizable olefin monomer based on weight of copolymer.

3. The monofilament of claim 1 wherein said vinylidene chloride copolymer comprises 35 to 96 weight percent vinylidene chloride, from about 3.5 to about 64.5 weight percent of an acrylic ester, and from about 0.5 to about 25 weight percent of itaconic acid based on weight of copolymer.

4. The monofilament of claim 1 wherein said vinylidene chloride copolymer comprises about 75 to about 95 weight percent vinylidene chloride, about 4 to about 20 weight percent of an acrylic ester, and about 1 to about 5 weight percent of itaconic acid based on weight of copolymer.

5. The monofilament of claim 3 wherein said acrylic ester is selected from alkyl esters of acrylic acid or methacrylic acid with 1 to 18 carbon atoms in the alkyl group.

6. The monofilament of claim 1 wherein said vinylidene chloride copolymer is blended with a polyacrylate ester.

7. The monofilament of claim 1 or 6 comprising a second coating wherein the coating comprising a vinylidine chloride is a first coating.

8. The monofilament of claim 7 wherein said second coating is selected from the group consisting of fluorinated surfactants.

9. The monofilament of claim 7 wherein said second coating is selected from the group consisting of polyolefins, cyclic olefin polymers, modified polyolefins, polyolefin copolymers, glycidyl esters of unsaturated acids, ionomers, ethylene/vinyl copolymers, ethylene/vinyl chloride capolymers, ethylene/vinyl acetate copolymers, ethylene/acrylic acid copolymers, ethylene/methacrylic acid copolymers, ethylene/vinyl alcohol copolymers, poly(vinyl, poly(vinyl alcohol-cobutyral), polyurethanes, thermoplastic polyurethanes, polyvinyl chloride, polyvinylidene chloride copolymers, liquid crystalline polymers, fluorinated polymers, polyamides, polyimides, polyphenylene sulfide, polyphenylene oxide, polysulfones, polyethersulfones, rubbers, polycarbonate, polyacrylates, terpene resins, polyacetal, styrene/acrylonitrile copolymers, styrene/maleic anhydride copolymers, styrene/maleimide copolymers, coumarone/indene copolymers, and combinations thereof.

10. The monofilament of claim 1, having a diameter from about 0.05 mm to about 5 mm.

11. The monofilament of claim 1 wherein said polyester comprises 99 to 100 mole percent of a dicarboxylic acid or lower ester of a dicarboxylic acid, 99 to 100 mole percent of a diol, and 0 to 1 mole percent of a polyfunctional branching agent.

12. The monofilament of claim 1, wherein the monofilament is drawn a second time to a maximum draw ratio of 6.5:1 and is heated at a temperature between the temperature of claim 1 and 250° C.

13. The monofilament of claim 12, wherein the monofilament is allowed to relax to about 30 percent of its maximum drawn length while heated in a relaxing stage.

14. The monofilament of claim 13, further comprising a second coating.

15. The monofilament of claim 1, wherein the drawn monofilament is heat set at a temperature in the range of 160° C. to 180° C.

* * * * *